US011771237B2

(12) United States Patent
Mountz

(10) Patent No.: US 11,771,237 B2
(45) Date of Patent: Oct. 3, 2023

(54) FOLDABLE PLAY YARD

(71) Applicant: Wonderland Switzerland AG, Steinhausen (CH)

(72) Inventor: Jonathan K. Mountz, Steinhausen (CH)

(73) Assignee: Wonderland Switzerland AG, Steinhausen (CH)

( * ) Notice: Subject to any disclaimer, the term of this patent is extended or adjusted under 35 U.S.C. 154(b) by 0 days.

(21) Appl. No.: 17/751,703

(22) Filed: May 24, 2022

(65) Prior Publication Data

US 2022/0279938 A1 Sep. 8, 2022

Related U.S. Application Data

(63) Continuation of application No. 17/033,974, filed on Sep. 28, 2020, now Pat. No. 11,369,211, which is a continuation of application No. 16/191,463, filed on Nov. 15, 2018, now Pat. No. 10,835,055.

(60) Provisional application No. 62/586,448, filed on Nov. 15, 2017.

(51) Int. Cl.
*A47D 13/06* (2006.01)

(52) U.S. Cl.
CPC ..... *A47D 13/061* (2013.01); *A47D 13/063* (2013.01)

(58) Field of Classification Search
CPC .... A47D 13/061; A47D 13/063; A47D 7/002; A47D 9/005; A47D 13/00; A47D 13/06; A47D 7/00; A47C 9/00
See application file for complete search history.

(56) References Cited

U.S. PATENT DOCUMENTS

| | | | | |
|---|---|---|---|---|
| 2008/0189854 | A1 | 8/2008 | Thorne | |
| 2012/0248394 | A1* | 10/2012 | Thorne | A47D 13/061 256/25 |
| 2019/0142183 | A1* | 5/2019 | Mountz | A47D 13/061 5/99.1 |
| 2020/0146465 | A1 | 5/2020 | Thorne | |
| 2020/0187673 | A1* | 6/2020 | Thorne | F16C 11/10 |

FOREIGN PATENT DOCUMENTS

| | | | |
|---|---|---|---|
| CN | 101305878 | A | 11/2008 |
| CN | 201175173 | Y | 1/2009 |
| CN | 203735845 | U | 7/2014 |
| CN | 203815058 | U | 9/2014 |
| CN | 104257165 | A | 1/2015 |
| CN | 104905602 | A | 9/2015 |
| CN | 204970477 | U | 1/2016 |
| EP | 3 207 827 | A1 | 8/2017 |

* cited by examiner

*Primary Examiner* — Fredrick C Conley
(74) *Attorney, Agent, or Firm* — Winston Hsu

(57) ABSTRACT

A foldable play yard is disclosed and includes a floor assembly, at least one top rail assembly and at least one corner post assembly. The at least one top rail assembly includes at least one upper beam. The at least one corner post assembly is movably coupled to the at least one upper beam. The floor assembly drives the at least one corner post assembly to drive the at least one upper beam to pivot to drive the at least one top rail assembly to be folded when the floor assembly is folded, and the floor assembly drives the at least one corner post assembly to drive the at least one upper beam to pivot to drive the at least one top rail assembly to be unfolded when the floor assembly is unfolded.

20 Claims, 26 Drawing Sheets

FOLDABLE PLAY YARD

CROSS REFERENCE TO RELATED APPLICATIONS

This application is a continuation application of U.S. application Ser. No. 17/033,974, filed on Sep. 28, 2020, which is a continuation application of U.S. application Ser. No. 16/191,463, filed on Nov. 15, 2018, which claims the benefit of U.S. Provisional Application No. 62/586,448, filed on Nov. 15, 2017. The contents of these applications are incorporated herein by reference.

BACKGROUND OF THE INVENTION

1. Field of the Invention

The present invention relates to a child product, and more particularly, to a foldable play yard which is easy to fold and unfold.

2. Description of the Prior Art

In order for caregivers to take care of their children, a number of child products are employed. A play yard is a structure with high sides that provides an enclosed area for a child to sleep or play therein. However, the conventional play yard requires multiple steps to fold and unfold, which is difficult for the caregivers to use and transport the play yard.

Therefore, there is a need to provide a foldable play yard which is easy to fold and unfold.

SUMMARY OF THE INVENTION

It is an objective of the present invention to provide a foldable play yard which is easy to fold and unfold for solving the aforementioned problem.

In order to achieve the aforementioned objective, the present invention discloses a foldable play yard. The foldable play yard includes a floor assembly, at least one top rail assembly and at least one corner post assembly. The at least one top rail assembly includes at least one upper beam. The at least one corner post assembly is movably coupled to the at least one upper beam. The floor assembly drives the at least one corner post assembly to drive the at least one upper beam to pivot to drive the at least one top rail assembly to be folded when the floor assembly is folded, and the floor assembly drives the at least one corner post assembly to drive the at least one upper beam to pivot to drive the at least one top rail assembly to be unfolded when the floor assembly is unfolded.

According to an embodiment of the present invention, the at least one corner post assembly includes a first column and a second column. A lower end of the first column is pivoted to the floor assembly. An upper end of the first column is movably connected to the at least one top rail assembly. The second column is movable relative to the first column. A lower end of the second column is movably connected to the floor assembly. An upper end of the second column is pivoted to the at least one top rail assembly. The floor assembly drives the second column to move relative to the first column to drive the at least one upper beam to pivot to drive the at least one top rail assembly to be folded when the floor assembly is folded, and the floor assembly drives the second column to move relative to the first column to drive the at least one upper beam to pivot to drive the at least one top rail assembly to be unfolded when the floor assembly is unfolded.

According to an embodiment of the present invention, the floor assembly includes a floor hub and at least one floor beam having a first end and a second end. The floor hub is pivoted to the first end of the at least one floor beam, and the lower end of the first column is pivoted to an intervening portion of the at least one floor beam between the first end and the second end of the at least one floor beam.

According to an embodiment of the present invention, at least one lower slot is formed on the second end of the at least one floor beam. The at least one corner post assembly further includes at least one lower pin adjacent to on the lower end of the second column and slidably passing through the at least one lower slot, and the lower end of the second column is rotatably and slidably disposed on the second end of the at least one floor beam by cooperation of the at least one lower pin and the at least one lower slot.

According to an embodiment of the present invention, the floor assembly further includes at least one latch pivoted to the lower end of the first column for engaging with the second column, so as to stop the second column from being driven by the at least one floor beam to move relative to the first column.

According to an embodiment of the present invention, the floor assembly further includes at least one cable connected to the at least one latch for driving the at least one latch to disengage from the second column to allow the second column to be driven by the at least one floor beam to move relative to the first column.

According to an embodiment of the present invention, the floor assembly further includes at least one resilient component for biasing the at least one latch to engage with the second column.

According to an embodiment of the present invention, the at least one corner post assembly further includes a wheel set disposed on the lower end of the first column.

According to an embodiment of the present invention, the second column is pivoted to the second end of the at least one floor beam.

According to an embodiment of the present invention, the floor assembly further includes at least one supporting base connected to the at least one floor beam, and the at least one floor beam drives the at least one supporting base to be located beneath the second column when the floor assembly is unfolded.

According to an embodiment of the present invention, the at least one corner post assembly further includes a wheel set disposed on the lower end of the second column. The wheel set is hidden between the at least one supporting base and the second column when the floor assembly is unfolded to drive the at least one supporting base to be located beneath the second column, and the wheel set is exposed when the floor assembly is folded to drive the at least one supporting base to leave from the second column.

According to an embodiment of the present invention, the floor assembly further includes at least one pivoting component pivoted to the lower end of the second column and the second end of the at least one floor beam.

According to an embodiment of the present invention, the first column is movably sleeved inside the second column.

According to an embodiment of the present invention, the at least one corner post assembly further includes an elastic component connected to the first column and the second column, and the elastic component is elastically deformed when the floor assembly is folded to drive the second column to move relative to the first column.

According to an embodiment of the present invention, the at least one upper beam has a first end and a second end. The at least one corner post assembly is pivoted to an intervening portion of the at least one upper beam between the first end and the second end of the at least one upper beam. An upper slot is formed on the second end of the at least one upper beam. The at least one corner post assembly further includes an upper pin slidably passing through the upper slot, and the at least one corner post assembly is rotatably and slidably disposed on the at least one upper beam by cooperation of the upper pin and the upper slot.

According to an embodiment of the present invention, the upper slot is inclined relative to the at least one corner post assembly when the foldable play yard is unfolded.

According to an embodiment of the present invention, the at least one corner post assembly includes a first column and a second column movable relative to the first column. An upper end of the second column is pivoted to the intervening portion of the at least one upper beam, and the upper pin is adjacent to an upper end of the first column.

According to an embodiment of the present invention, the at least one top rail assembly further includes a bracket pivoted to the first end of the at least one upper beam.

According to an embodiment of the present invention, the at least one top rail assembly further includes at least one lower beam having a first end and a second end. The first end of the at least one lower beam is pivoted to the bracket, and the second end of the at least one lower beam is pivoted to the at least one corner post assembly.

According to an embodiment of the present invention, the foldable play yard includes two corner post assemblies. The at least one top rail assembly includes two upper beams and two lower beams. Two pivoting points of the bracket and first ends of the two upper beams and two pivoting points of the bracket and first ends of the two lower beams are arranged in a trapezoid. A horizontal distance between the two pivoting points of the bracket and the first ends of the two upper beams is less than a horizontal distance between the two pivoting points of the bracket and the first ends of the two lower beams, and a horizontal distance between two pivoting points of the two corner post assemblies and the two upper beams is less than a horizontal distance between two pivoting points of the two corner post assemblies and the two lower beams.

In summary, the present invention utilizes the corner post assembly to drive the top rail assembly to be folded when the floor assembly is folded and further to drive the top rail assembly to be unfolded when the floor assembly is unfolded. Furthermore, the floor assembly of the present invention is foldable by operating the floor hub. Therefore, it allows caregiver to fold and unfold the entire foldable play yard of the present invention easily by operating the floor hub of the floor assembly even with one hand. Besides, the present invention provides compact folding characteristics. Therefore, it allows the caregiver to transport the foldable play yard easily.

These and other objectives of the present invention will no doubt become obvious to those of ordinary skill in the art after reading the following detailed description of the preferred embodiment that is illustrated in the various figures and drawings.

DETAILED DESCRIPTION

In the following detailed description of the preferred embodiments, reference is made to the accompanying drawings which form a part hereof, and in which is shown by way of illustration specific embodiments in which the invention may be practiced. In this regard, directional terminology, such as "top," "bottom," "front," "back," etc., is used with reference to the orientation of the Figure(s) being described. The components of the present invention can be positioned in a number of different orientations. As such, the directional terminology is used for purposes of illustration and is in no way limiting. Accordingly, the drawings and descriptions will be regarded as illustrative in nature and not as restrictive.

The present invention discloses a foldable play yard including a floor assembly, at least one top rail assembly and at least one corner post assembly. The at least one corner post assembly includes a first column and a second column. Each of the first column and the second column is pivoted and/or movably connected to the floor assembly and the top rail assembly. In such a way, the floor assembly can drive the second column to move relative to the first column to drive the at least one top rail assembly to be folded when the floor assembly is folded, for the same reason, the floor assembly can drive the second column to move relative to the first column to drive the at least one top rail assembly to be unfolded when the floor assembly is unfolded, which can achieve a purpose of quick folding or unfolding of the foldable play yard 1. Detailed description for the foldable play yards of the following three exemplary embodiments is provided as follows. However, the structure and the configuration of the foldable play yard of the present invention are not limited to those embodiments. Any structure or any configuration which can achieve the aforementioned purpose is included within the scope of the present invention.

Figure 1:
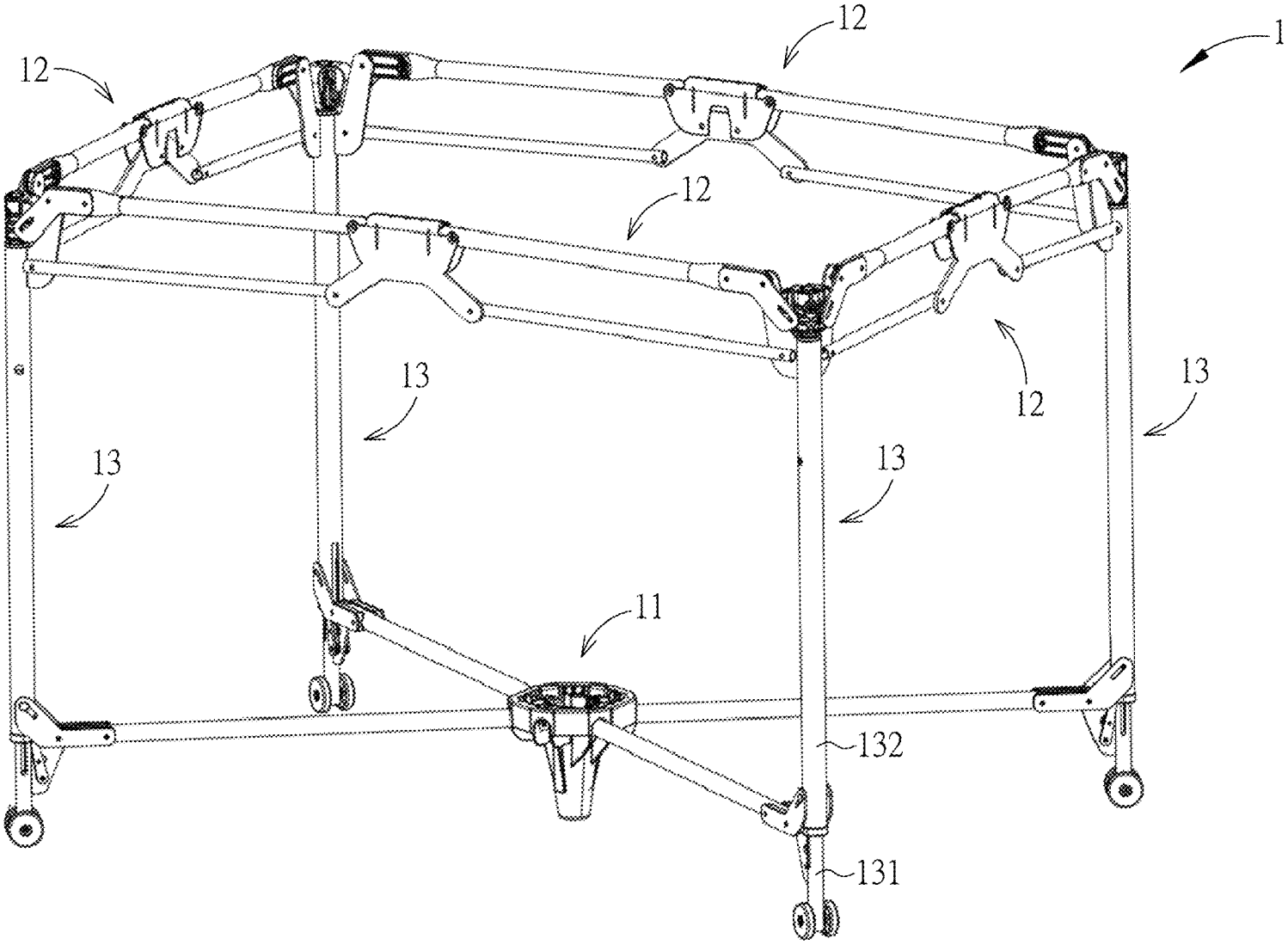
FIG. 1 is a schematic diagram of a foldable play yard in an unfolded state according to a first embodiment of the present invention.
Figure 2:
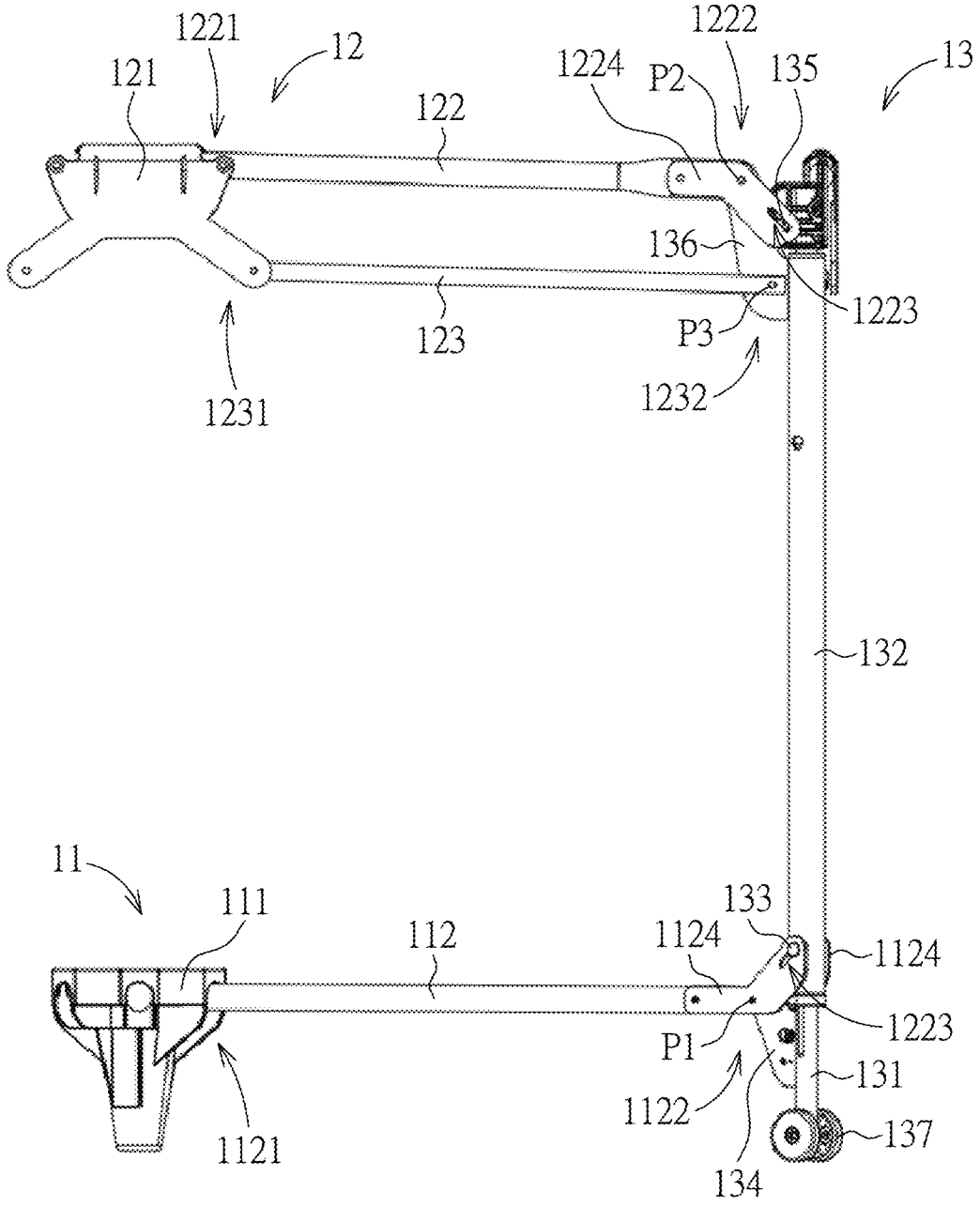
FIG. 2 is a partial lateral view diagram of the foldable play yard according to the first embodiment of the present invention.

Please refer to FIG. 1 and FIG. 2. FIG. 1 is a schematic diagram of a foldable play yard 1 in an unfolded state according to a first embodiment of the present invention. FIG. 2 is a partial lateral view diagram of the foldable play yard 1 according to the first embodiment of the present invention. As shown in FIG. 1 and FIG. 2, the foldable play yard 1 includes a floor assembly 11, four top rail assemblies 12 and four corner post assemblies 13. Each corner post assembly 13 includes a first column 131 and a second column 132 movable relative to the first column 131. A lower end of the first column 131 of each corner post assembly 13 is pivoted to the floor assembly 11, and an upper end of the first column 131 of each corner post assembly 13 is movably connected to the two corresponding top rail assemblies 12. A lower end of the second column 132 of each corner post assembly 13 is movably connected to the floor assembly 11, and an upper end of the second column 132 of each corner post assembly 13 is pivoted to the two corresponding top rail assemblies 12. When the floor assembly 11 is operated to be folded or unfolded, the floor assembly 11 can drive the four corner post assemblies 13 to fold or unfold the four top rail assemblies 12, which achieves a purpose of folding or unfolding the entirely foldable play yard 1. Understandably, the foldable play yard 1 can further include a soft cloth, which is not shown in the figures. The floor assembly 11, the four top rail assemblies 12 and the four corner post assemblies 13 are covered by the soft cloth. It is noteworthy that the numbers of the top rail assembly 12 and the corner post assembly 13 are not limited to this embodiment. For example, in another embodiment, the foldable play yard 1 can include one top rail assembly 12 at one side and one corner post assembly 13 at one corner.

In this embodiment, each first column 131 can be movably sleeved inside the corresponding second column 132 along a vertical direction. However, it is not limited to this embodiment. Any configuration which can perform the aforementioned function of folding or unfolding the entirely foldable play yard 1 is within the scope of the present invention. For example, in another embodiment, each first column 131 and the corresponding second column 132 also can be disposed side by side.

Figure 3:
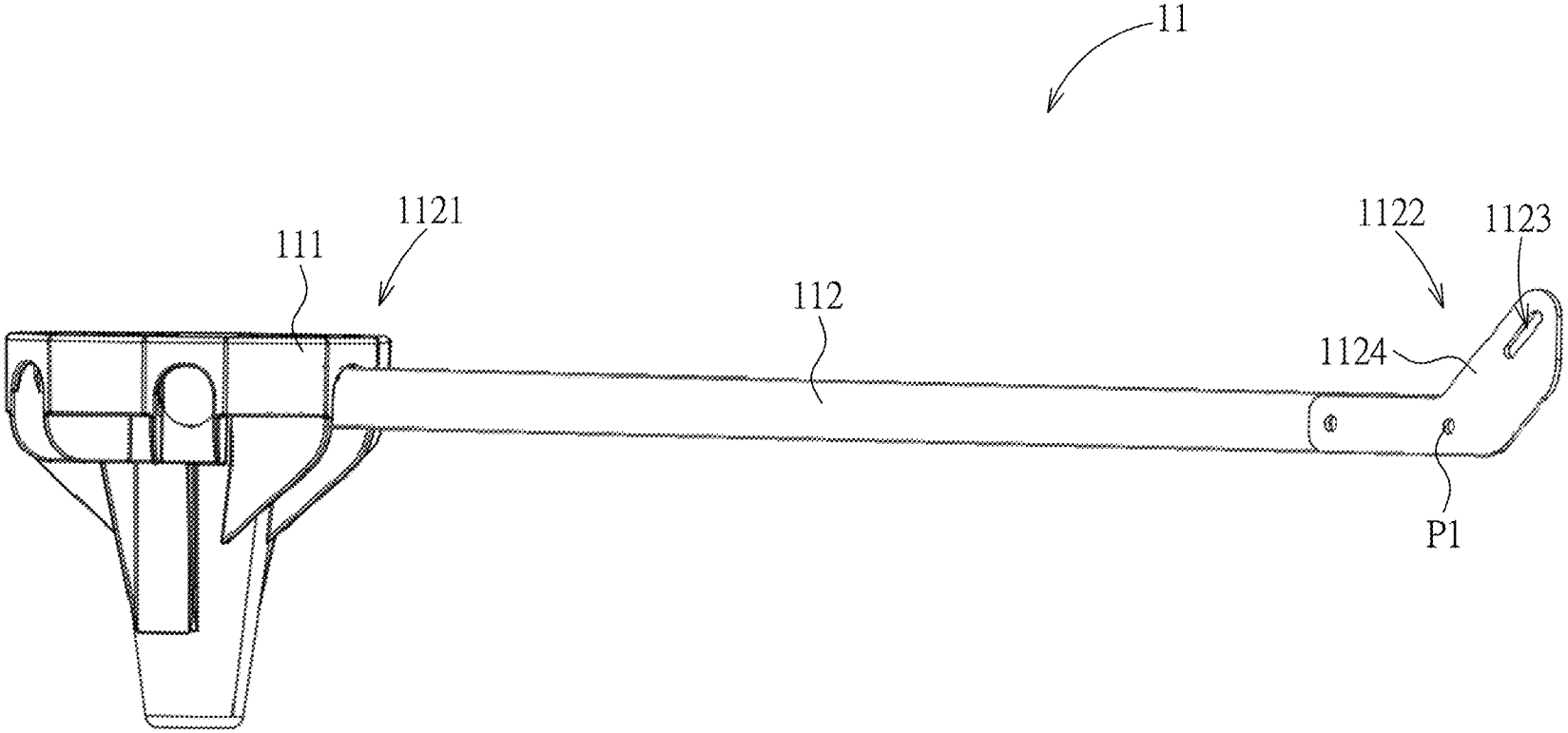
FIG. 3 is a partial diagram of a floor assembly according to the first embodiment of the present invention.
Figure 4:
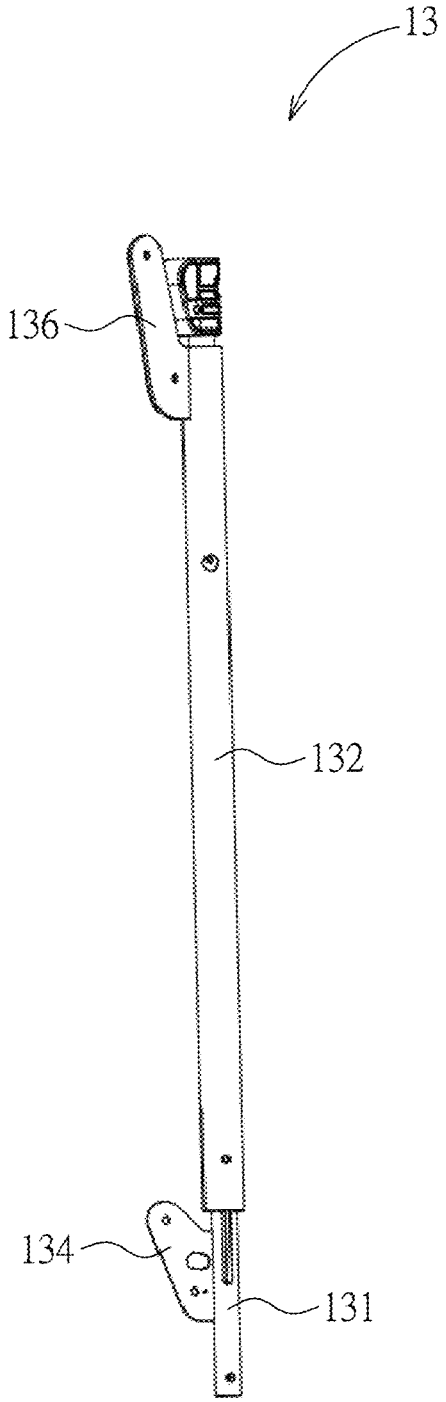
FIG. 4 is a partial diagram of a corner post assembly according to the first embodiment of the present invention.
Figure 5:
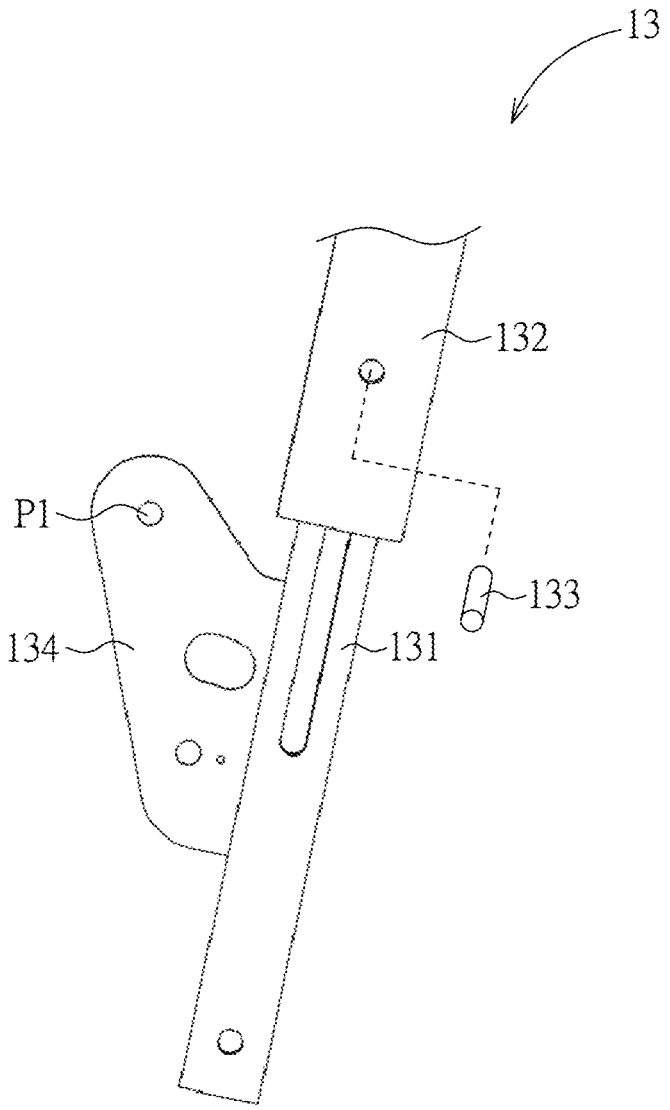
FIG. 5 is an enlarged diagram of a lower end of the corner post assembly according to the first embodiment of the present invention.
Figure 6:
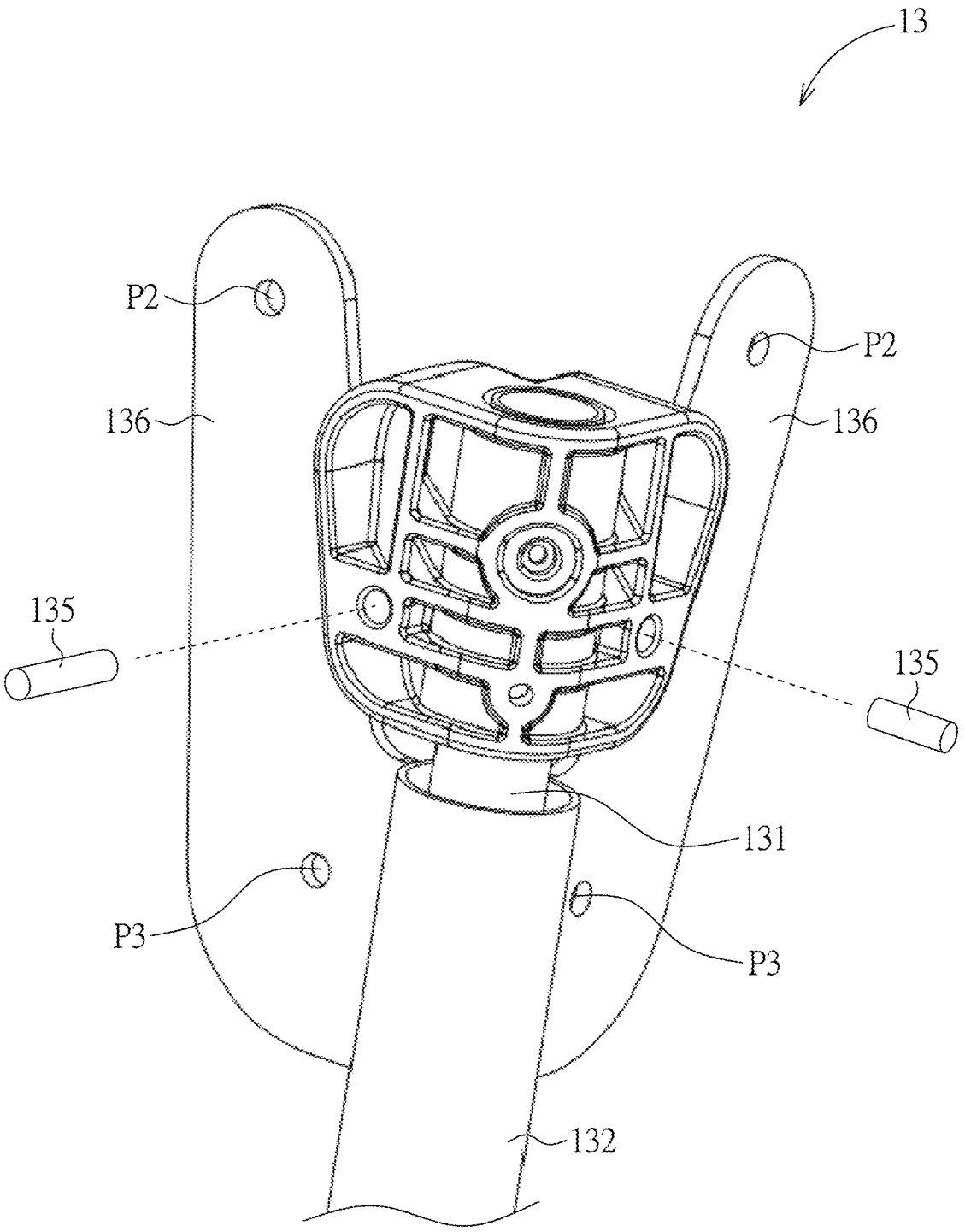
FIG. 6 is an enlarged diagram of an upper end of the corner post assembly according to the first embodiment of the present invention.
Figure 7:
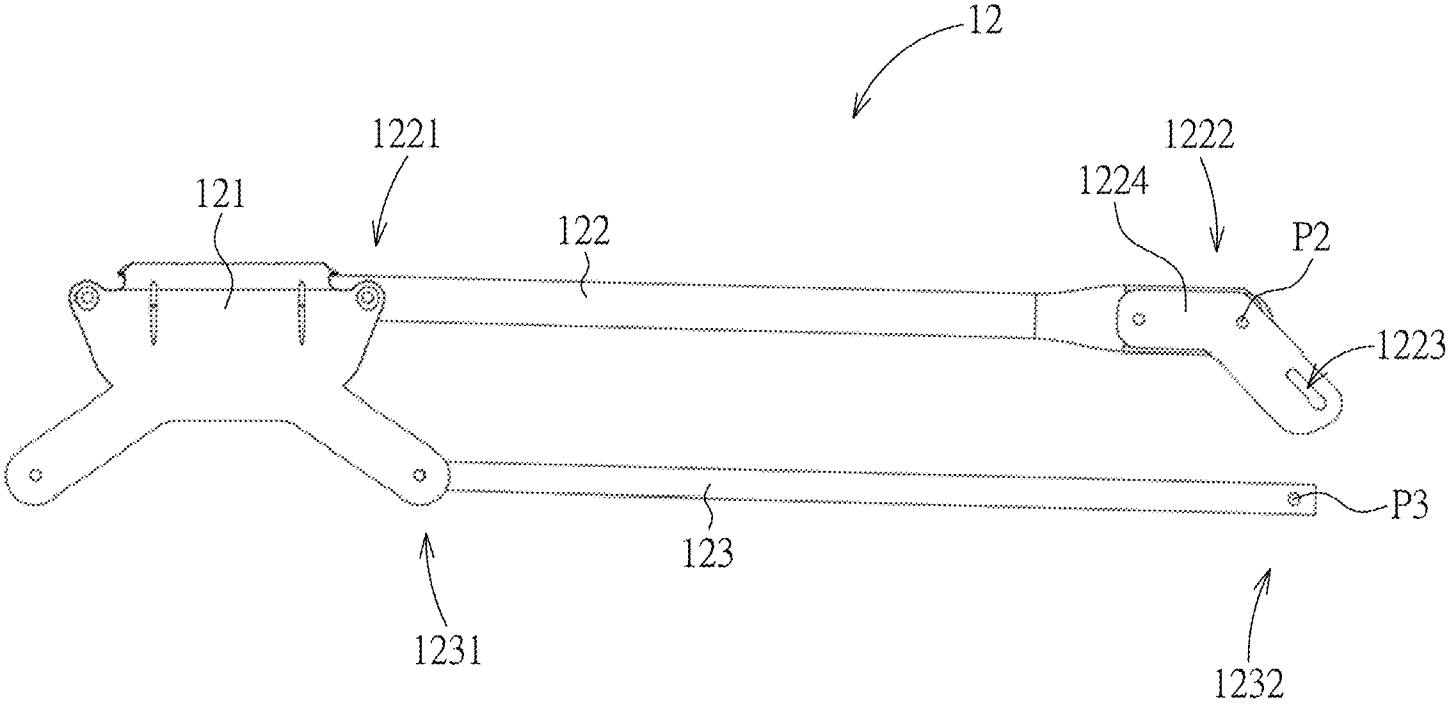
FIG. 7 is a partial diagram of a top rail assembly according to the first embodiment of the present invention.

Specifically, please refer to FIG. 1 to FIG. 7. FIG. 3 is a partial diagram of the floor assembly 11 according to the first embodiment of the present invention. FIG. 4 is a partial diagram of the corner post assembly 13 according to the first embodiment of the present invention. FIG. 5 is an enlarged diagram of a lower end of the corner post assembly 13 according to the first embodiment of the present invention. FIG. 6 is an enlarged diagram of an upper end of the corner post assembly 13 according to the first embodiment of the present invention. FIG. 7 is a partial diagram of the top rail assembly 12 according to the first embodiment of the present invention. In order to illustrate details of the foldable play yard 1, FIG. 3 to FIG. 7 only illustrate partial components of the floor assembly 11, partial components of one of the four corner post assemblies 13 at one side, and partial components of one of the four top rail assemblies 12 at one side, respectively.

As shown in FIG. 1 to FIG. 5, the floor assembly 11 includes a floor hub 111 and four floor beams 112. Each floor beam 112 has a first end 1121 and a second end 1122 away from each other. The floor hub 111 is pivoted to the first end 1121 of each floor beam 112, so that the floor assembly 11 is foldable by a pivoting movement of the floor hub 111 relative to the four floor beams 112.

For driving the folding of the foldable play yard 1, the four floor beams 112 may be coupled to the lower ends of the four second columns 132, therefore, each second column 132 may be subject to the pivoting movement of the corresponding floor beams 112 and follows the movement. In a preferred embodiment, the lower end of each second column 132 is rotatably and slidably disposed on the second end of the corresponding floor beam 112. More detailedly, the second end 1122 of each floor beam 112 includes at least one lower connecting plate 1124, and each lower connecting plate 1124 having a lower slot 1123. The lower slot 1123 is inclined relative to the second column 132 when the foldable play yard 1 is unfolded. Each corner post assembly 13 includes at least one lower pin 133 adjacent to the lower end of the second column 132 and slidably passing through the at least one lower slot 1123 on the corresponding floor beam 112, so that the lower end of the second column 132 of each corner post assembly 13 is rotatably and slidably disposed on the second end 1122 of the corresponding floor beam 112 by cooperation of the at least one lower pin 133 and the at least one corresponding lower slot 1123. It is noteworthy that the numbers of the floor beam 112, the lower connecting plate 1124, the lower slot 1123 and the lower pin 133 are not limited to this embodiment.

To make the second column 132 to move relative to the first column 131, each floor beam 112 may be coupled to the corresponding first column 131 in the same time. In a preferred embodiment, the lower end of each first column 131 is pivoted to the second end 1122 of the corresponding floor beam 112 while the lower end of each second column 132 is rotatably and slidably disposed on the second end 1122 of the corresponding floor beam 112. More detailedly, the lower end of the first column 131 of each corner post assembly 13 further includes a lower pivoting plate 134. The lower end of the first column 131 of each corner post assembly 13 is pivoted to an intervening portion of the corresponding floor beam 112 located between the first end 1121 and the at least one lower slot 1123 on the second end 1122 of the corresponding floor beam 112 by the lower pivoting plate 134 at a pivoting point P1. In other words, each floor beam 112 extends horizontally and turns toward the at least one lower slot 1123 at the pivoting point P1.

As shown in FIG. 1, FIG. 2, FIG. 4, FIG. 6 and FIG. 7, each top rail assembly 12 includes a bracket 121 and two upper beams 122 on the two sides of the bracket 121. Each top rail assembly 12 can be folded or unfolded by pivoting movements of the two upper beams 122 relative to the bracket 121 while the two upper beams 122 is receiving and subject to the movement of the second columns 132 relative to the first columns 131. In a preferred embodiment, the two upper beams 122 are located at two opposite sides of an upper portion of the bracket 121. Each upper beam 122 has a first end 1221 and a second end 1222 away from each other. The first ends 1221 of the two upper beams 122 are pivoted to the two opposite sides of the upper portion of the bracket 121. The second end 1222 of each upper beam 122 includes at least one upper connecting plate 1224, and each upper connecting plate 1124 having an upper slot 1223. The upper slot 1223 is inclined relative to the first column 131 when the foldable play yard 1 is unfolded. Each corner post assembly 13 further includes at least one upper pin 135 adjacent to the upper end of the first column 131 and slidably passing through the at least one corresponding upper slot 1223 on the corresponding upper beams 122, so that the upper end of the first column 131 of each corner post assembly 13 is rotatably and slidably disposed on the corresponding upper beams 122 by cooperation of the at least one upper pin 135 and the at least one corresponding upper slot 1223. Furthermore, the upper end of the second column 132 of each corner post assembly 13 includes at least one upper pivoting plate 136 pivoted to intervening portions of the corresponding upper beams 122 between the first ends 1221 and the at least one upper slot 1223 of the second ends 1222 of the corresponding upper beams 122 at second pivoting points P2. In other words, each upper beam 122 extends horizontally and turns toward the at least one upper slot 1223 at the pivoting point P2. It is noteworthy that the numbers of the upper beam 122, the upper slot 1223 and the upper pin 135 are not limited to this embodiment.

To achieve a purpose of ensuring symmetry and stability of a vertical movement of the second columns 132 relative to the first columns 131 during folding and unfolding operations of the foldable play yard 1, in a preferred embodiment, each top rail assembly 12 further may further includes two lower beams 123 pivoted to the bracket 121, located at two opposite sides of a lower portion of the bracket 121 and substantially parallel to the two upper beams 122. More detailedly, as shown in FIG. 1, FIG. 2 and FIG. 7, each lower beam 123 has a first end 1231 and a second end 1232 away from each other. The first ends 1231 of the two lower beams 123 are pivoted to the two opposite sides of the lower portion of the bracket 121. Besides, the second end 1232 of each lower beam 123 is pivoted to the corresponding upper pivoting plate 136 at a pivoting point P3.

Besides, in a preferred embodiment, two pivoting points of the bracket 121 and the first ends 1221 of the two adjacent upper beams 122 and two pivoting points of the bracket 121 and the first ends 1231 of the two adjacent lower beams 123 can be arranged in a trapezoid, and a horizontal distance between the two pivoting points of the bracket 121 and the first ends 1221 of the two adjacent upper beams 122 can be less than a horizontal distance between the two pivoting points of the bracket 121 and the first ends 1231 of the two adjacent lower beams 123. Furthermore, a horizontal distance between the two pivoting points P2 at two corners can be less than a horizontal distance between the two pivoting points P3 at two corners.

Figure 8:
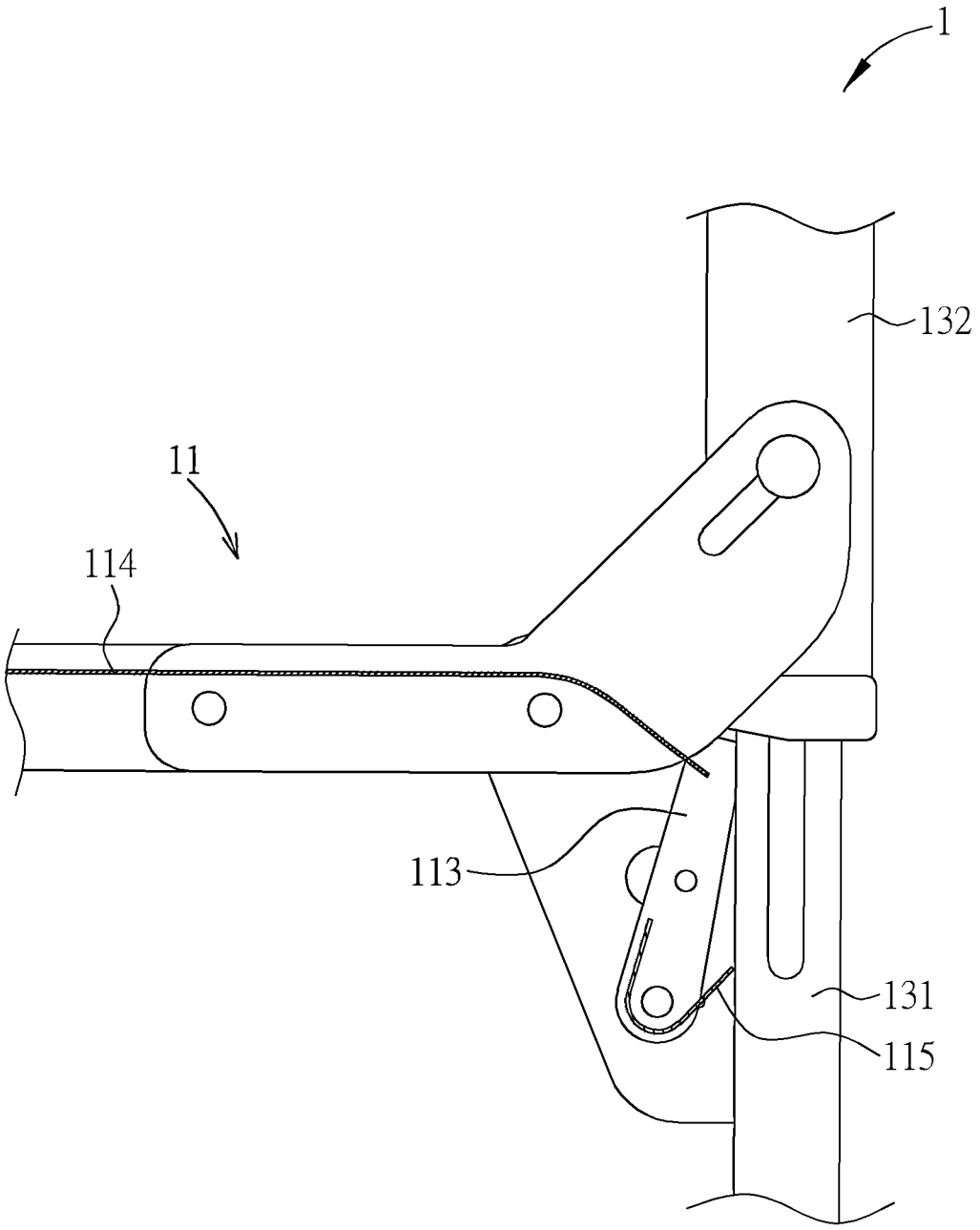
FIG. 8 is a partial diagram of the foldable play yard shown in FIG. 1 according to the first embodiment of the present invention.

Please refer to FIG. 1 and FIG. 8. FIG. 8 is a partial diagram of the foldable play yard 1 shown in FIG. 1 according to the first embodiment of the present invention. As shown in FIG. 1 and FIG. 8, the floor assembly 11 further includes four latches 113, four cables 114 and four resilient components 115. Each latch 113 is pivoted to the lower end of the first column 131 of the corresponding corner post assembly 13, and each cable 114 is connected to the corresponding latch 113. Each latch 113 is for engaging with the corresponding second column 132, so as to stop the corresponding second column 132 from being driven by the corresponding floor beam 112 to move relative to the corresponding first column 131. Each cable 114 is for driving the corresponding latch 113 to disengage from the corresponding second column 132 to allow the corresponding second column 132 to be driven by the corresponding floor beam 112 to move relative to the corresponding first column 131. Each resilient component 115 is for biasing the corresponding latch 113 to engage with the corresponding second column 132. In other words, when the foldable play yard 1 is in the unfolded state as shown in FIG. 1, the latches 113 can be operated to engage with the second columns 132 to prevent the second columns 132 from moving relative to the first columns 131, so as to prevent the foldable play yard 1 from being folded unintentionally. Furthermore, in this embodiment, each cable 114 can preferably be connected to an actuator on the floor hub 111, and it allows caregiver to disengage the latches 113 from the second columns 132 by operating the actuator on the floor hub 111 and then fold the foldable play yard 1 by moving the floor hub 111 easily, which provides convenience in use. However, the numbers of the latch 113, the cable 114 and the resilient component 115 are not limited to this embodiment. For example, in another embodiment, the floor assembly 11 also can include only one latch 113, one cable 114 and one resilient component 115. Alternatively, in another embodiment, the latch 113, the cable 114, or the resilient component 115 even can be omitted selectively.

In order to facilitate the folding and unfolding process of the foldable play yard 1, in a preferred embodiment, at least one wheel set is provided on the lower end of the corner post assembly. As shown in FIG. 2, each corner post assembly 13 further includes a wheel set 137 disposed on the lower end of the first column 131. The wheel set 137 can reduce the amount of friction between the foldable play yard 1 and the ground or a supporting surface in order to ease the folding and unfolding process. However, it is not limited to this embodiment. For example, in another embodiment, each corner post assembly 13 can include two wheel sets 137. Alternatively, in another embodiment, the wheel set 137 even can be omitted.

Figure 9:
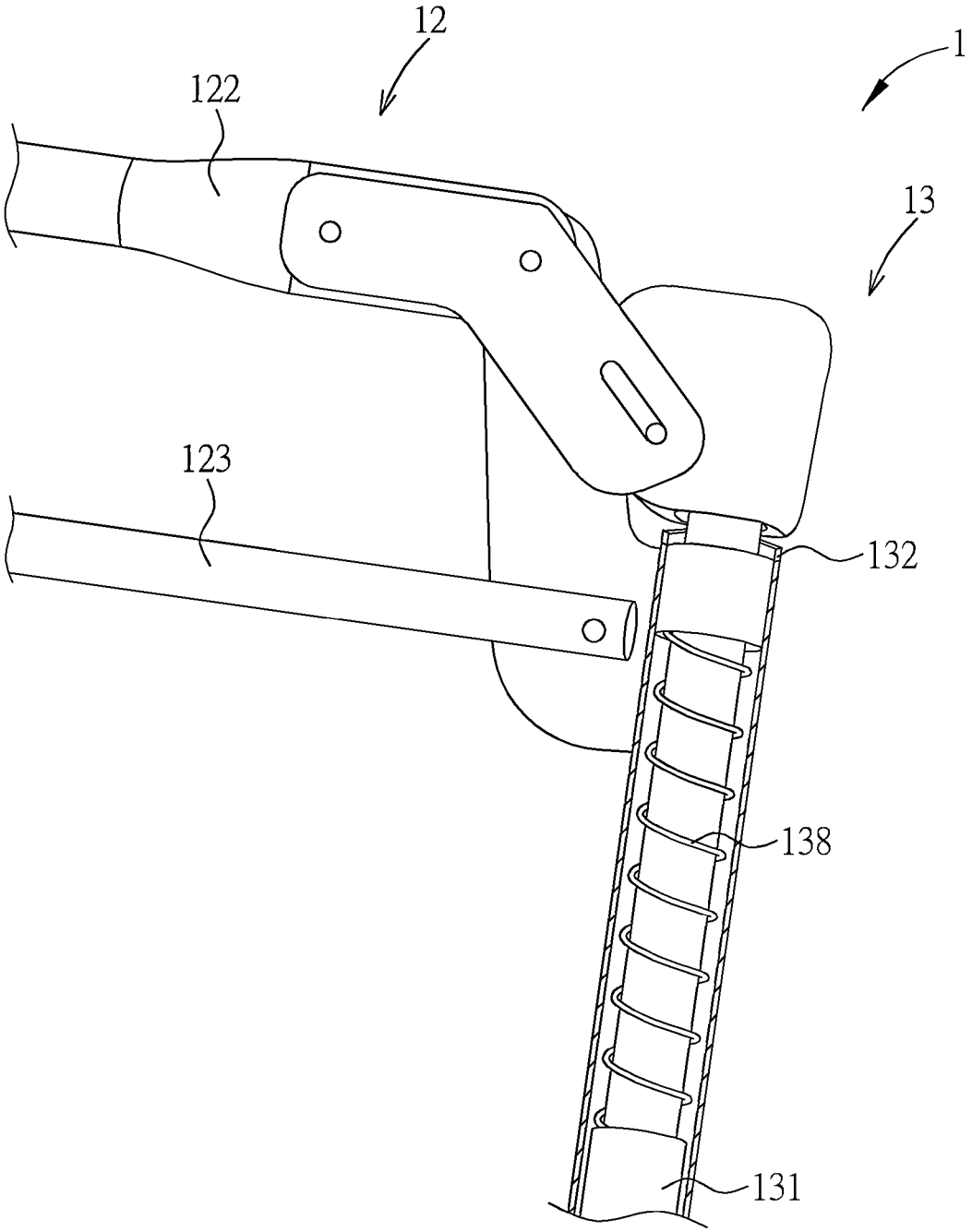
FIG. 9 is a partial internal structural diagram of the foldable play yard shown in FIG. 1 according to the first embodiment of the present invention.

In order to facilitate the caregiver to unfold the foldable play yard 1, in a preferred embodiment, at least one elastic component is provided inside the corner post assembly. Please refer to FIG. 9. FIG. 9 is a partial internal structural diagram of the foldable play yard shown in FIG. 1. As shown in FIG. 9, each corner post assembly 13 further includes an elastic component 138 connected to the first column 131 and the second column 132. The elastic components 138 are elastically deformed when the floor assembly 11 is folded to drive the second columns 132 to move relative to the first columns 131, so that the deformed elastic components 138 can provide elastic recovering forces to facilitate the caregiver to unfold the foldable play yard 1. However, it is not limited to this embodiment. For example, in another embodiment, the elastic component 138 can be omitted.

Figure 10:
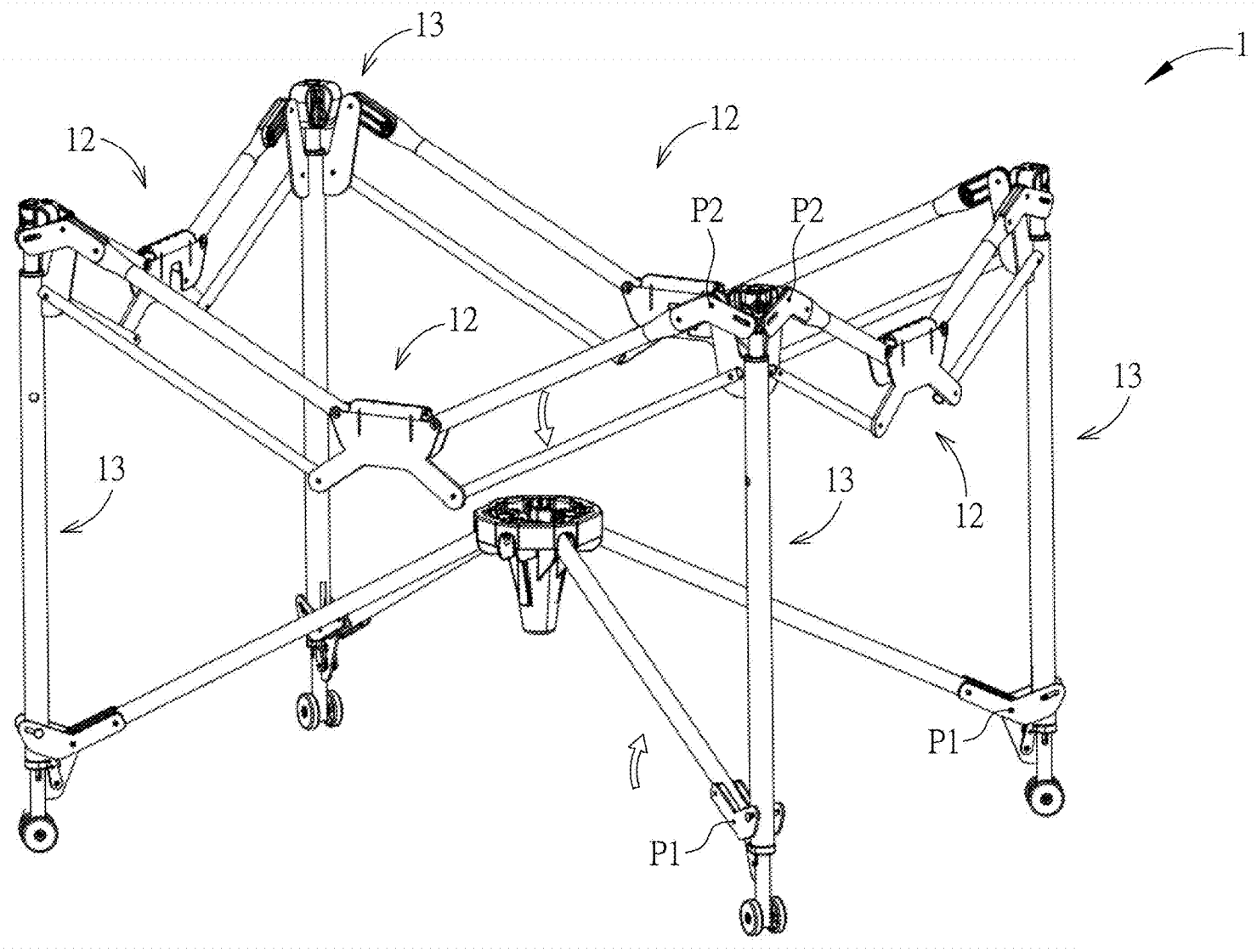
FIG. 10 is a diagram of the foldable play yard in a state between the unfolded state and a folded state according to the first embodiment of the present invention.
Figure 11:
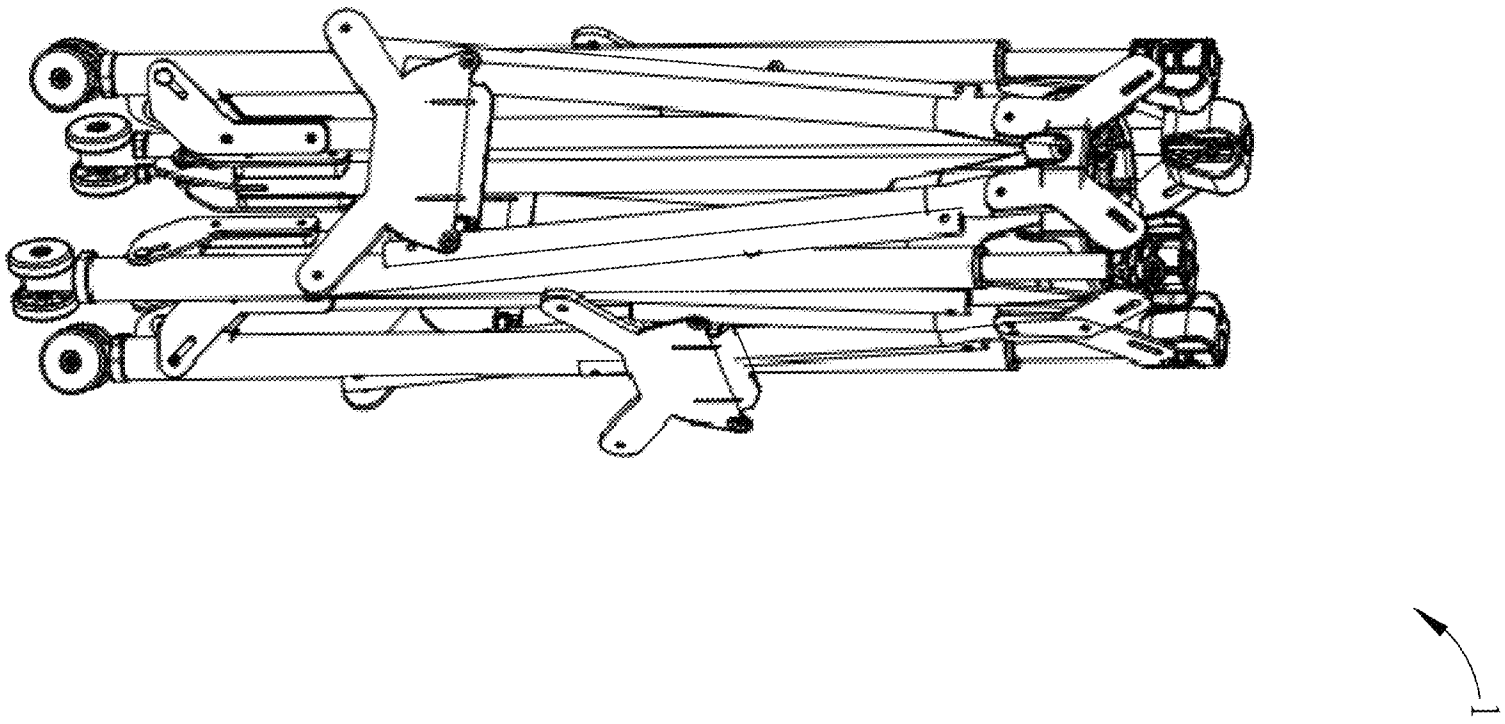
FIG. 11 is a diagram of the foldable play yard in the folded state according to the first embodiment of the present invention.
Figure 12:
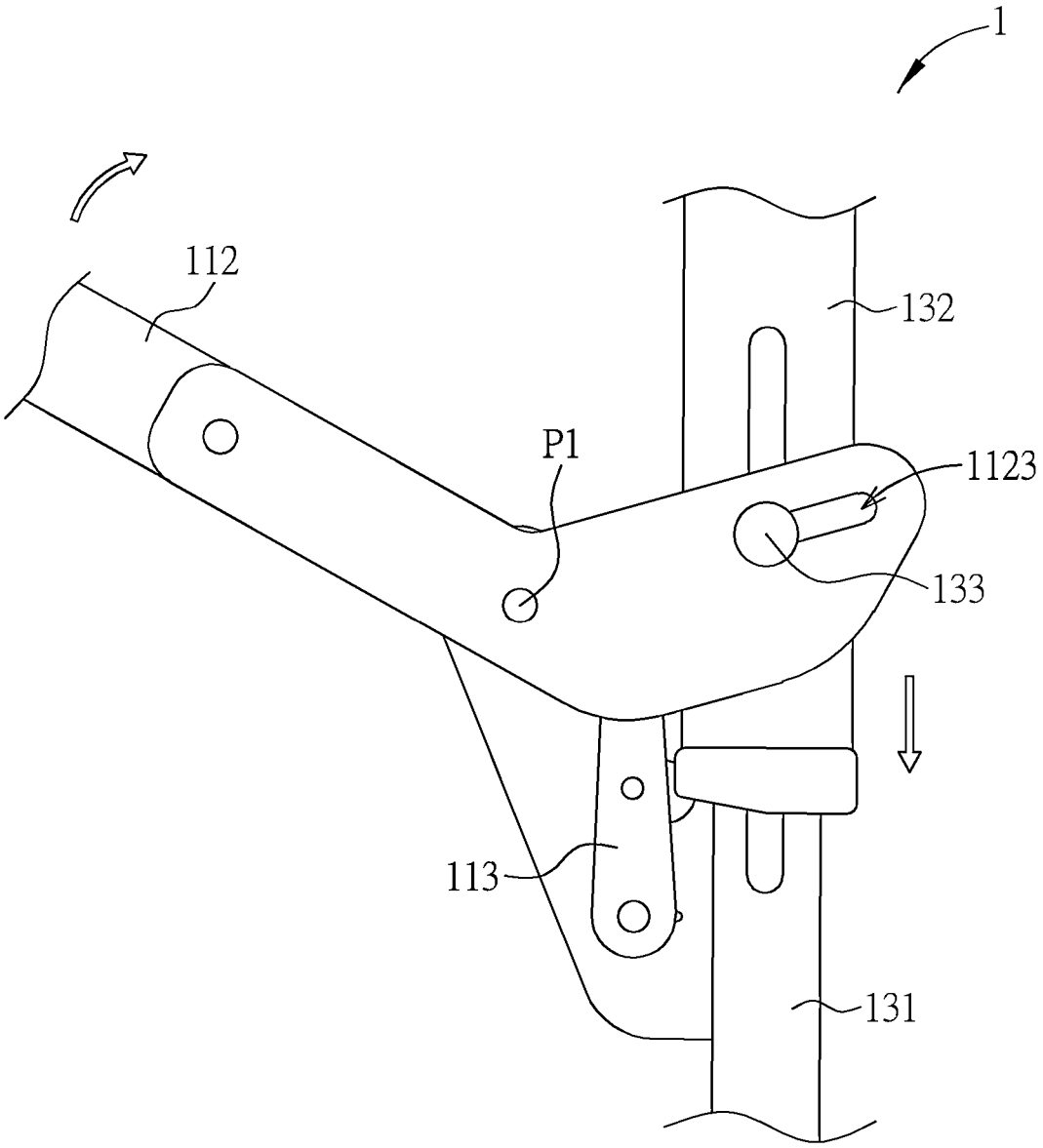
FIG. 12 is a partial diagram of the foldable play yard shown in FIG. 10 according to the first embodiment of the present invention.
Figure 13:
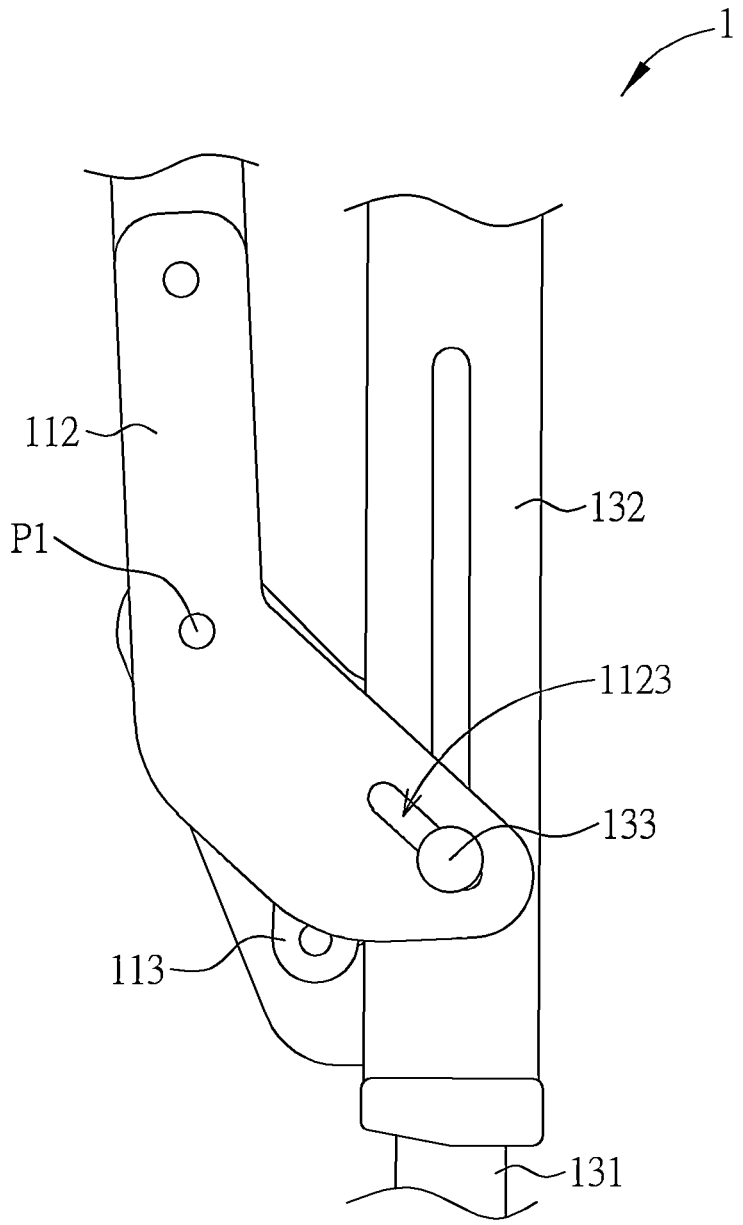
FIG. 13 is a partial diagram of the foldable play yard shown in FIG. 11 according to the first embodiment of the present invention.
Figure 14:
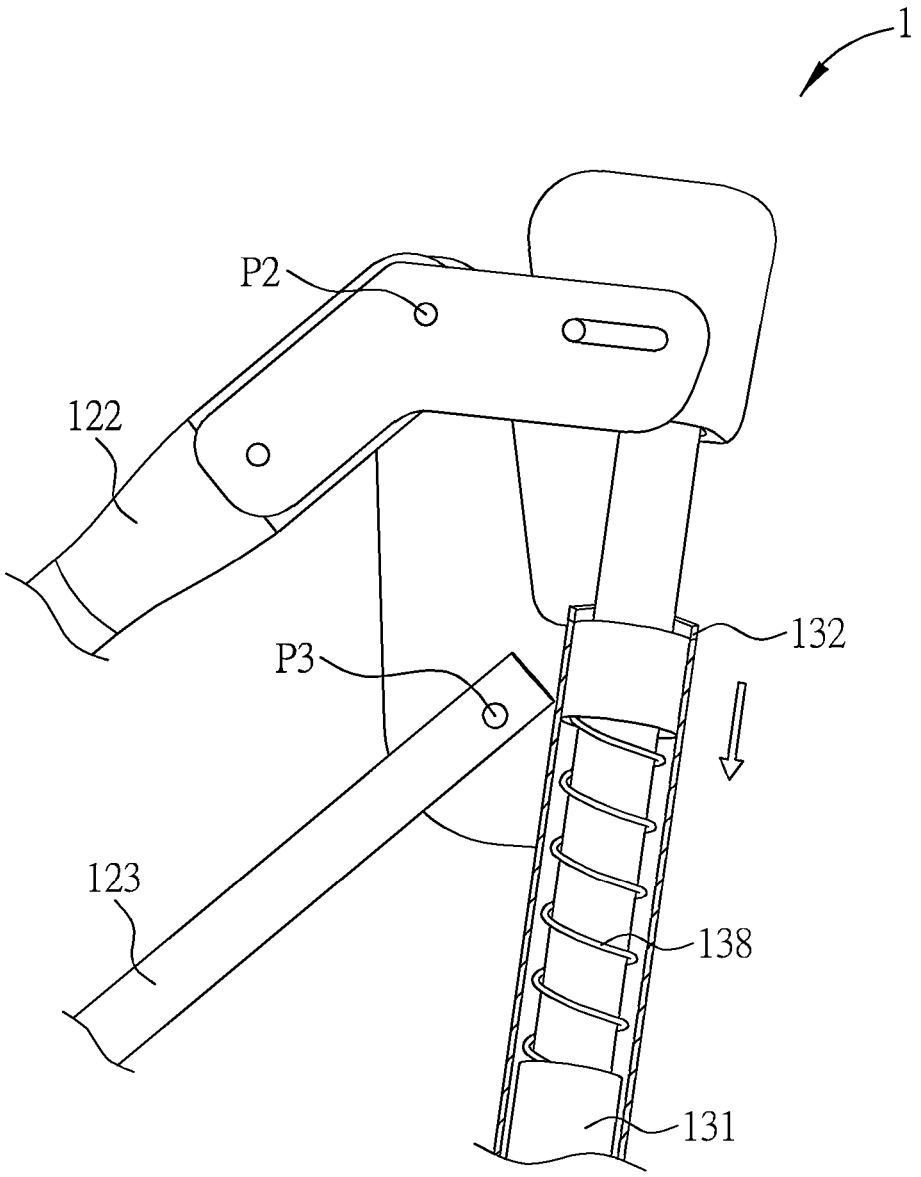
FIG. 14 is a partial internal structural diagram of the foldable play yard shown in FIG. 10 according to the first embodiment of the present invention.

Please refer to FIG. 1, FIG. 8 to FIG. 14. FIG. 10 is a diagram of the foldable play yard 1 in a state between the unfolded state and a folded state according to the first embodiment of the present invention. FIG. 11 is a diagram of the foldable play yard 1 in the folded state according to the first embodiment of the present invention. FIG. 12 is a partial diagram of the foldable play yard 1 shown in FIG. 10 according to the first embodiment of the present invention. FIG. 13 is a partial diagram of the foldable play yard 1 shown in FIG. 11 according to the first embodiment of the present invention. FIG. 14 is a partial internal structural diagram of the foldable play yard 1 shown in FIG. 10 according to the first embodiment of the present invention. When it is desired to fold the foldable play yard 1 from the unfolded state as shown in FIG. 1 to the folded state as shown in FIG. 11, the cables 114 can be operated to drive the latches 113 to pivot to leave from a position as shown in FIG. 8, to disengage from the second columns 132 for allowing the vertical movements of the second columns 132 relative to the first columns 131. For example, the cables 114 can be driven to disengage the latches 133 from the second columns 132 by operating the actuator on the floor hub 111. Afterwards, the floor hub 111 can be operated to move upwardly to fold the foldable play yard 1 to the folded state as shown in FIG. 11. However, it is not limited thereto. For example, in another embodiment, the cables 114 also can be configured to be driven to disengage the latches 113 from the second columns 132 when the floor hub 111 is lifted.

Furthermore, as shown in FIG. 1, FIG. 8 and FIG. 10 to FIG. 13, in a preferred embodiment, when the floor hub 111 is moved upwardly, the floor hub 111 can drive the first ends 1121 of the floor beams 112 to pivot upwardly about the pivoting points P1 relative to the first columns 131. During the aforementioned process, the floor beams 112 can drive the second columns 132 by the cooperation of the lower pins 133 and the lower slots 1123 to move relative to the first columns 131 downwardly from positions as shown in FIG. 8 to positions as shown in FIG. 13 via positions as shown in FIG. 12. When the second columns 132 are driven to move relative to the first columns 131 downwardly, the first ends 1221 of the upper beams 122 can be driven to pivot downwardly about the pivoting points P2 relative to the second columns 132 by the cooperation of the upper pins 135 and the upper slots 1223 to move the brackets 121 downwardly, so that the first ends 1231 of the lower beams 123 can be driven to pivot downwardly about the pivoting points P3 relative to the second columns 132, which can maintain symmetry and stability of the foldable play yard 1 during the aforementioned folding operation. In other words, the entire foldable play yard 1 can be folded by lifting the floor hub 111 of the floor assembly 11, and therefore, it allows the caregiver to fold the foldable play yard 1 easily even with one hand for easy storage and transportation. Furthermore, as shown in FIG. 9 and FIG. 14, when the second columns 132 are driven to move relative to the first columns 131 downwardly, the elastic components 138 are forced to be compressed.

On the other hand, when it is desired to unfold the foldable play yard 1 from the folded state as shown in FIG. 11, it only has to move the floor hub 111 downwardly. When the floor hub 111 moves downwardly, the floor hub 111 can drive the first ends 1121 of the floor beams 112 to pivot downwardly about the pivoting points P1 relative to the first columns 131. During the aforementioned unfolding process, the floor beams 112 can drive the second columns 132 by the cooperation of the lower pins 133 and the lower slots 1123 to move relative to the first columns 131 upwardly. When the second columns 132 are driven to move relative to the first columns 131 upwardly, the first ends 1221 of the upper beams 122 can be driven to pivot upwardly about the pivoting points P2 relative to the second columns 132 by the cooperation of the upper pins 135 and the upper slots 1223 to move the brackets 121 upwardly, so that the first ends 1231 of the lower beams 123 can be driven to pivot upwardly about the pivoting points P3 relative to the second columns 132, which can maintain symmetry and stability of the foldable play yard 1 during the aforementioned unfolding operation. In other words, the entire foldable play yard 1 can be unfolded by pressing down the floor hub 111 of the floor assembly 11, and therefore, it allows the caregiver to unfold the foldable play yard 1 easily even with one hand. Furthermore, during the aforementioned unfolding process, the compressed elastic components 138 can provide elastic recovering forces to facilitate the caregiver to unfold the foldable play yard 1 more easily.

Figure 15:
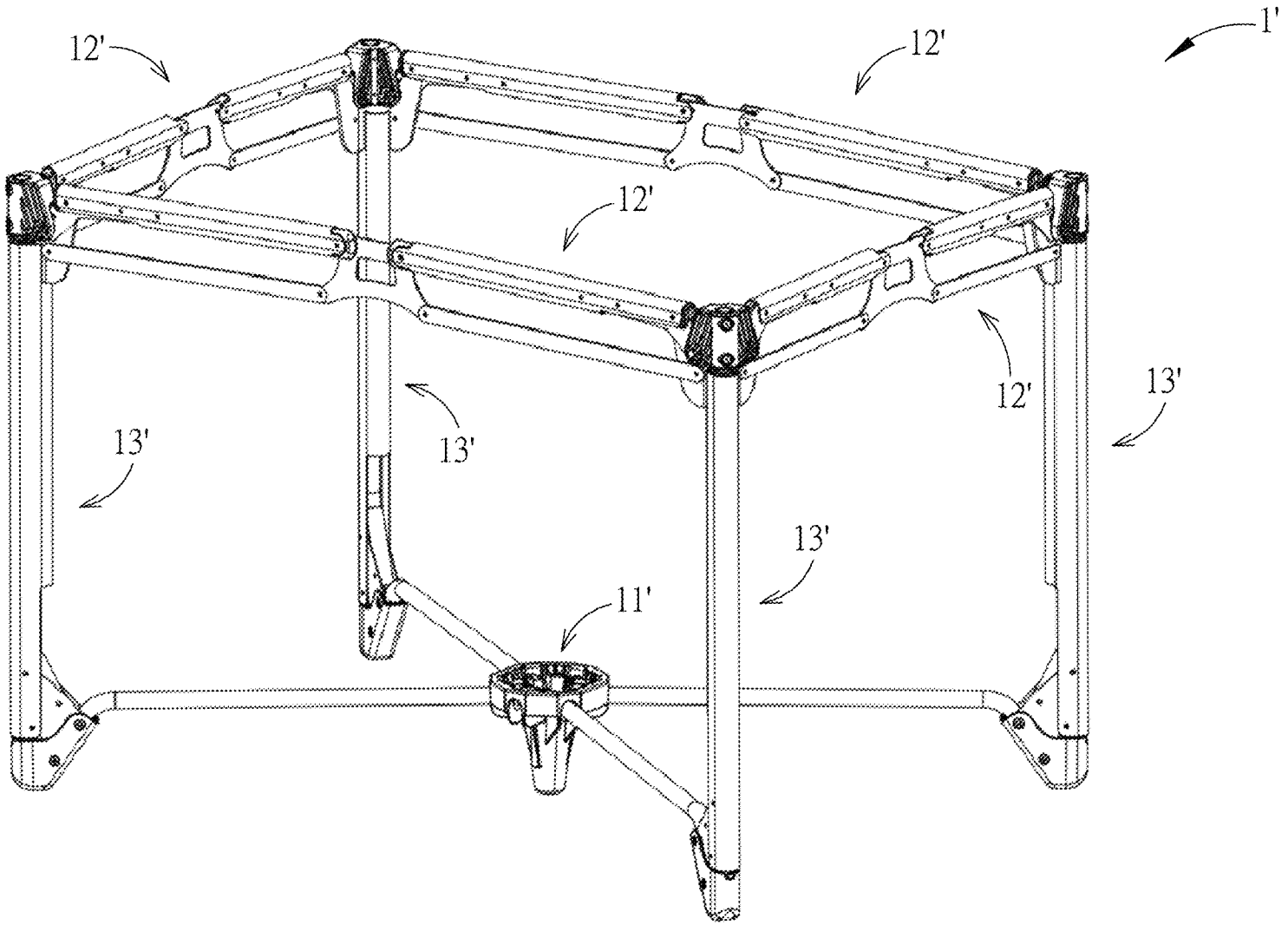
FIG. 15 is a schematic diagram of a foldable play yard in the unfolded state according to a second embodiment of the present invention.
Figure 16:
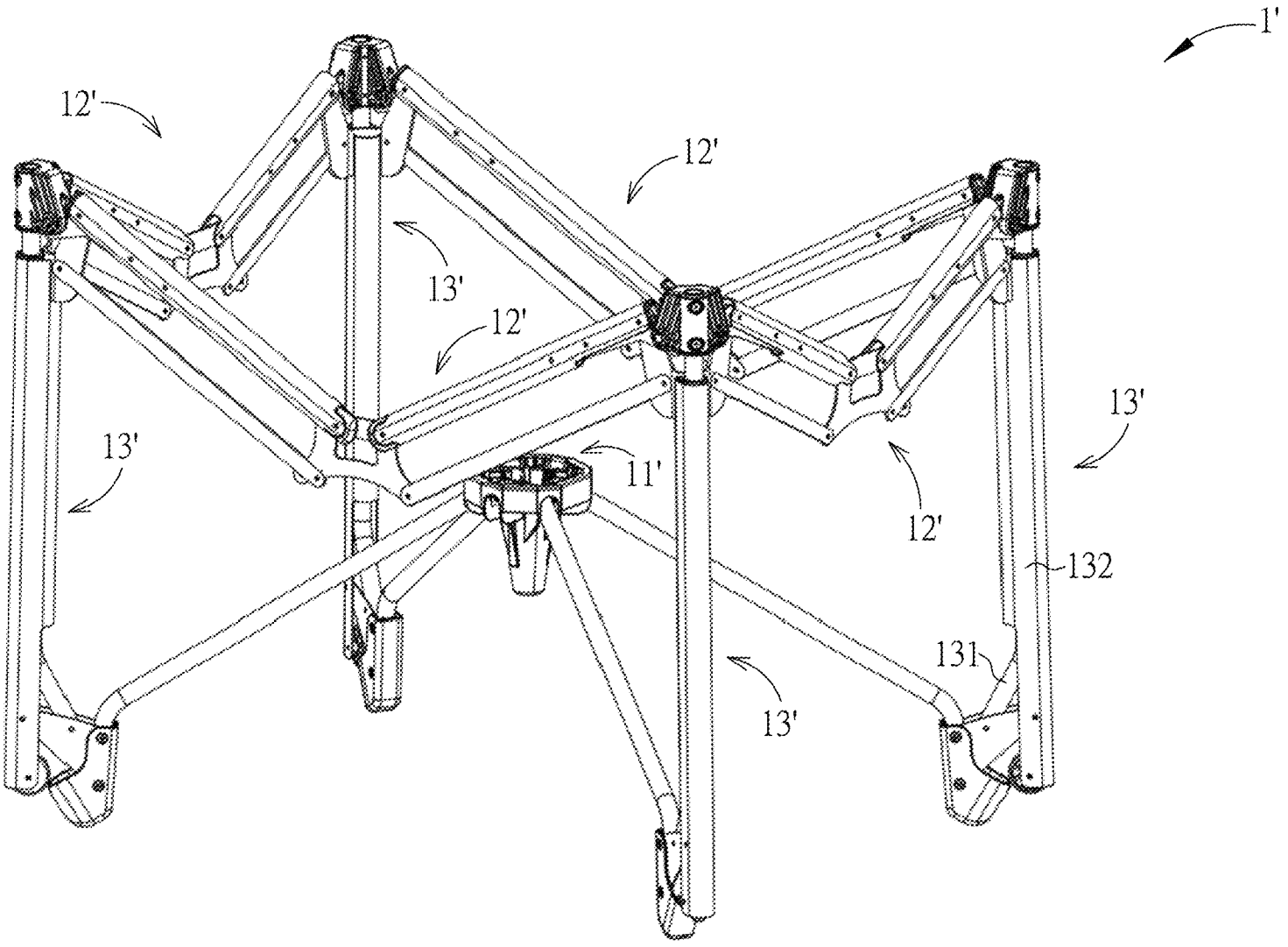
FIG. 16 is a diagram of the foldable play yard in a state between the unfolded state and the folded state according to the second embodiment of the present invention.
Figure 17:
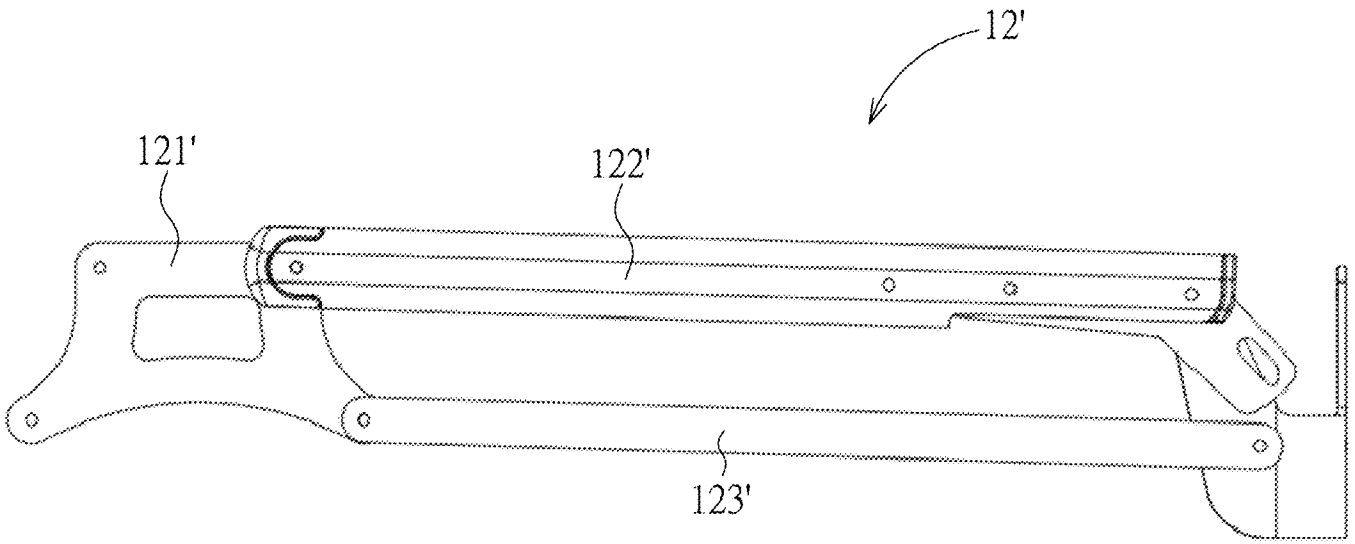
FIG. 17 is a partial diagram of a top rail assembly according to the second embodiment of the present invention.
Figure 18:
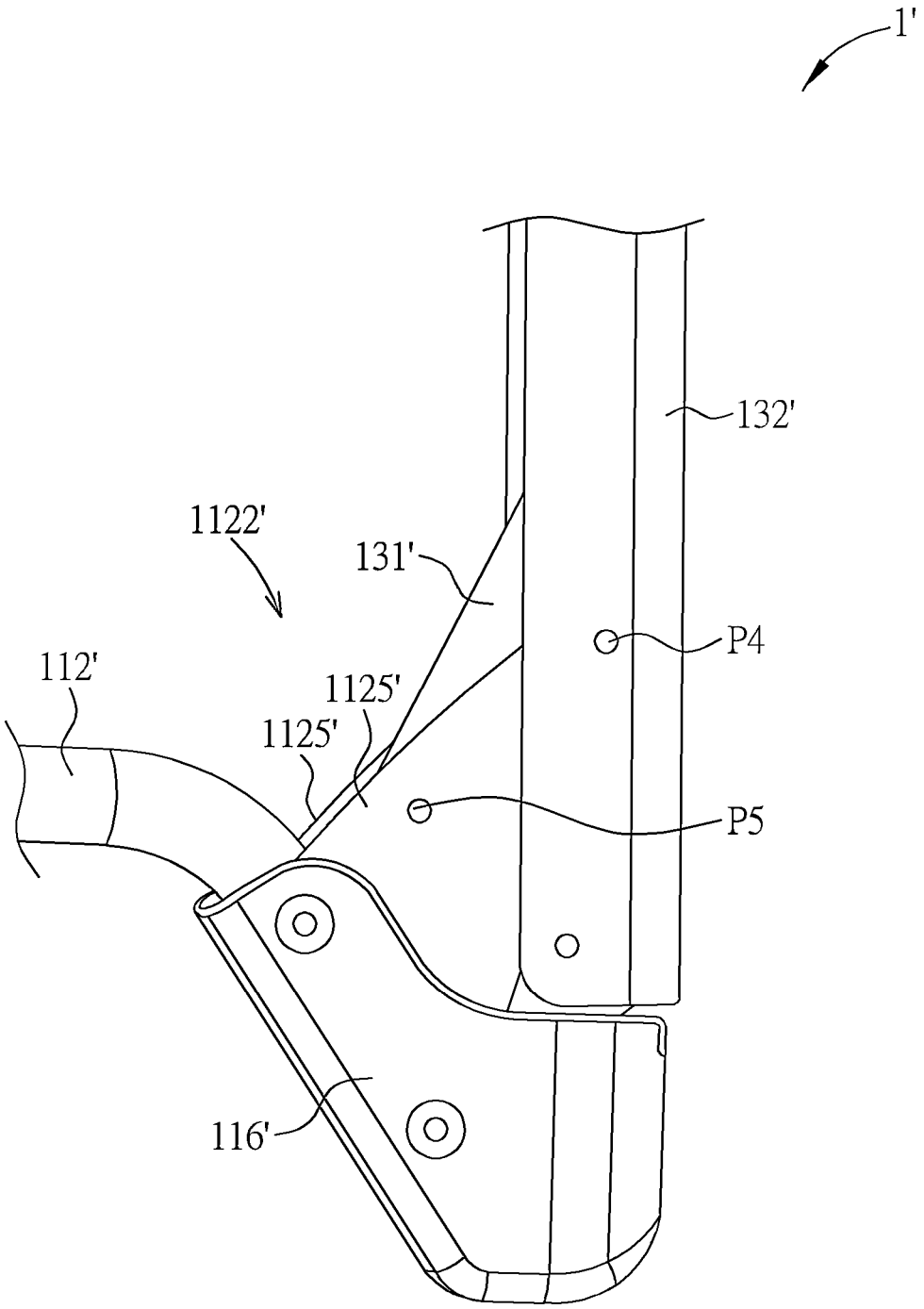
FIG. 18 to FIG. 20 are partial diagrams of the foldable play yard in different states according to the second embodiment of the present invention.
Figure 19:
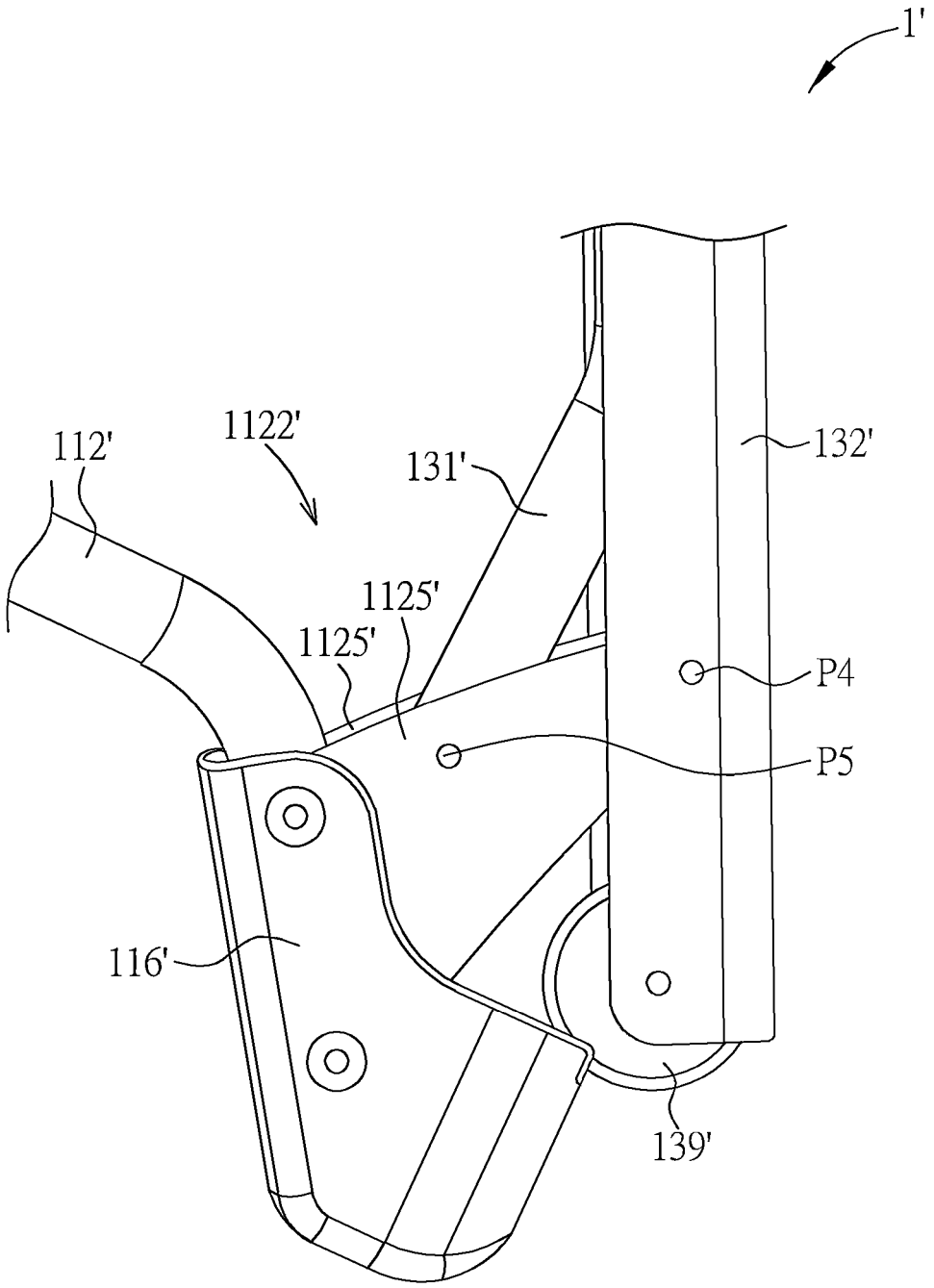
Figure 20:
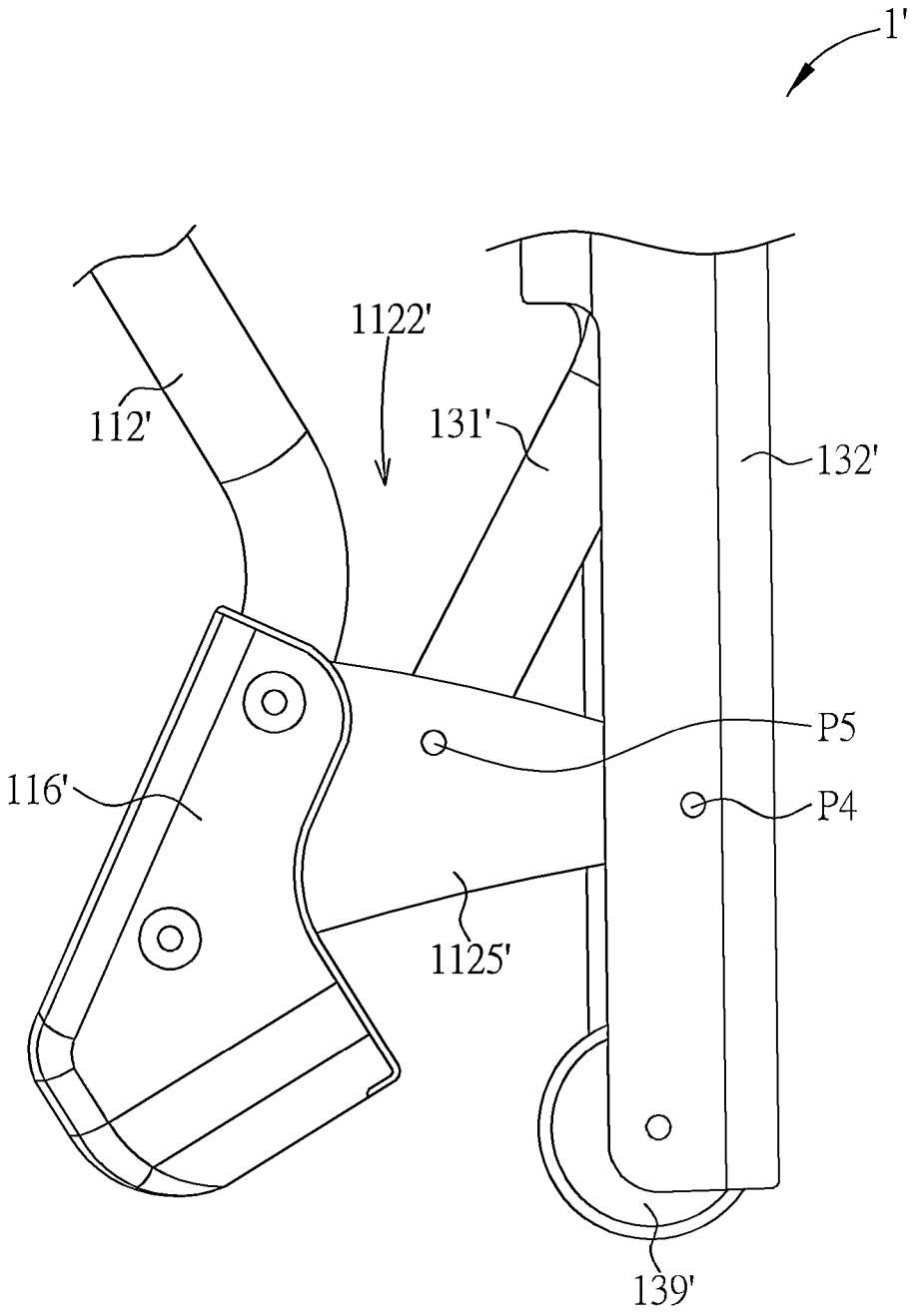

Please refer to FIG. 15 to FIG. 20. FIG. 15 is a schematic diagram of a foldable play yard 1' in the unfolded state according to a second embodiment of the present invention. FIG. 16 is a diagram of the foldable play yard 1' in a state between the unfolded state and the folded state according to the second embodiment of the present invention. FIG. 17 is a partial diagram of a top rail assembly 12' according to the second embodiment of the present invention. FIG. 18 to FIG. 20 are partial diagrams of the foldable play yard 1' in different states according to the second embodiment of the present invention. As shown in FIG. 15 to FIG. 20, the foldable play yard 1' of this embodiment includes a floor assembly 11', four top rail assemblies 12' and four corner post assemblies 13'. Each corner post assembly 13' includes a first column 131' and a second column 132'. Structure and operation of the top rail assembly 12' and upper ends of the first column 131' and the second column 132' of the corner post assembly 13' of this embodiment are similar to the ones of the first embodiment. Detailed description is omitted herein for simplicity. Different from the aforementioned embodiment, the floor assembly 11' of this embodiment includes a floor hub 111', four floor beams 112' pivoted to the floor hub 111' and four supporting bases 116' connected to second ends 1122' of the four floor beams 112'. Specifically, the second end 1122' of each floor beam 112' includes at least one pivoting plates 1125' connected to the corresponding supporting base 116'. Each pivoting plate 1125' is pivoted to a lower end of the corresponding second column 132' at a pivoting point P4 and to a lower end of the corresponding first column 131' at a pivoting point P5. In other words, each floor beam 112' extends horizontally and turns toward the pivoting point P4 at the pivoting point P5. Furthermore, each corner post assembly 13' includes a wheel set 139' disposed on the lower end of the second column 132'. As shown in FIG. 15 to FIG. 20, the floor beams 112' can drive the supporting bases 116' to pivot about the pivoting points P4 relative to the second columns 132' when the floor assembly 11' is unfolded or folded. Each wheel set 139' is hidden between the corresponding supporting base 116' and the corresponding second column 132' when the floor assembly 11' is unfolded. In other words, when the supporting bases 116' is driven to pivot downwardly about the pivoting points P4 and be located beneath the second columns 132' during a unfolding process of the floor assembly 11', the wheel set 139' are hidden between the supporting bases 116' and the second column 11'. On the other hand, each wheel set 139' is exposed when the floor assembly 11' is folded. In other words, when the supporting bases 116' is driven to pivot upwardly about the pivoting points P4 to leave from the second columns 132' during a folding process of the floor assembly 11', the wheel sets 139' are exposed. Therefore, in this embodiment, the wheel set 139' also can reduce the amount of friction between the foldable play yard 1' and the ground or a supporting surface in order to ease the folding and unfolding process, and the foldable play yard 1' can stably stand on the ground or the supporting surface with the supporting bases 116' when the foldable play yard 1' is unfolded. It is noteworthy that the numbers of supporting base 116' and the pivoting plate 1125' are not limited to this embodiment.

Figure 21:
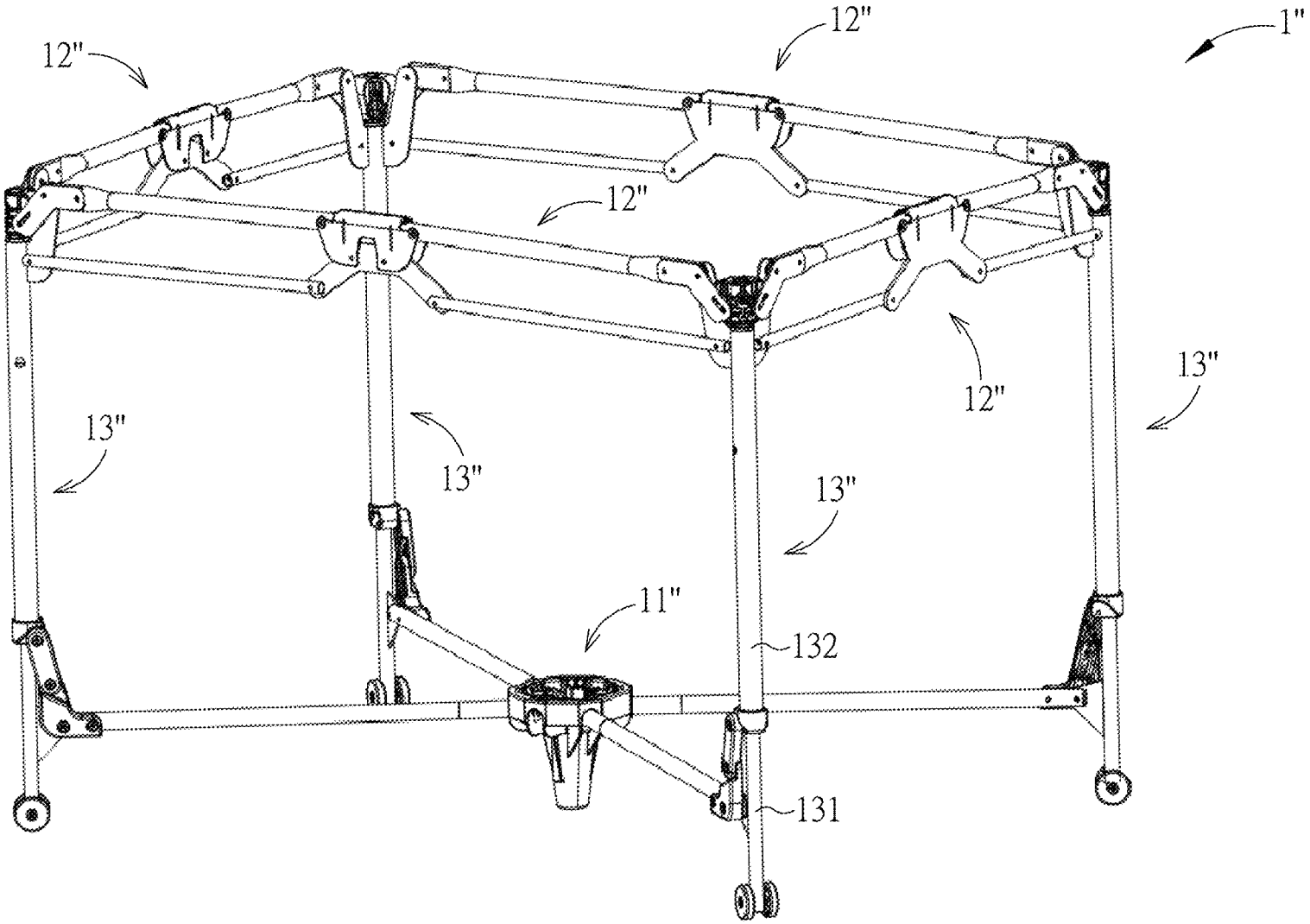
FIG. 21 is a schematic diagram of a foldable play yard in the unfolded state according to a third embodiment of the present invention.
Figure 22:
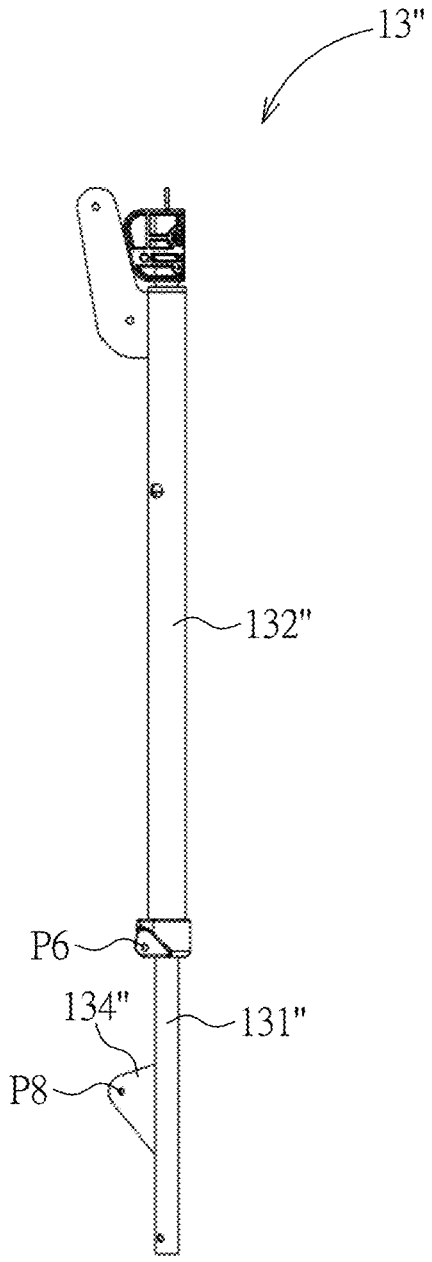
FIG. 22 is a partial diagram of a corner post assembly according to the third embodiment of the present invention.
Figure 23:
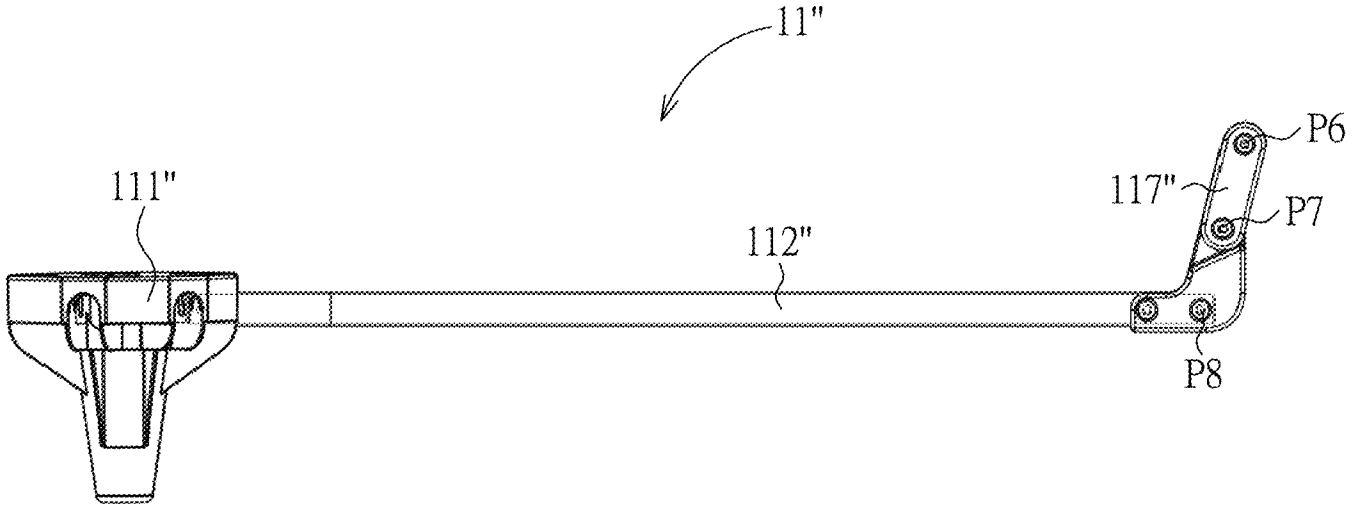
FIG. 23 is a partial diagram of a floor assembly according to the third embodiment of the present invention.
Figure 24:
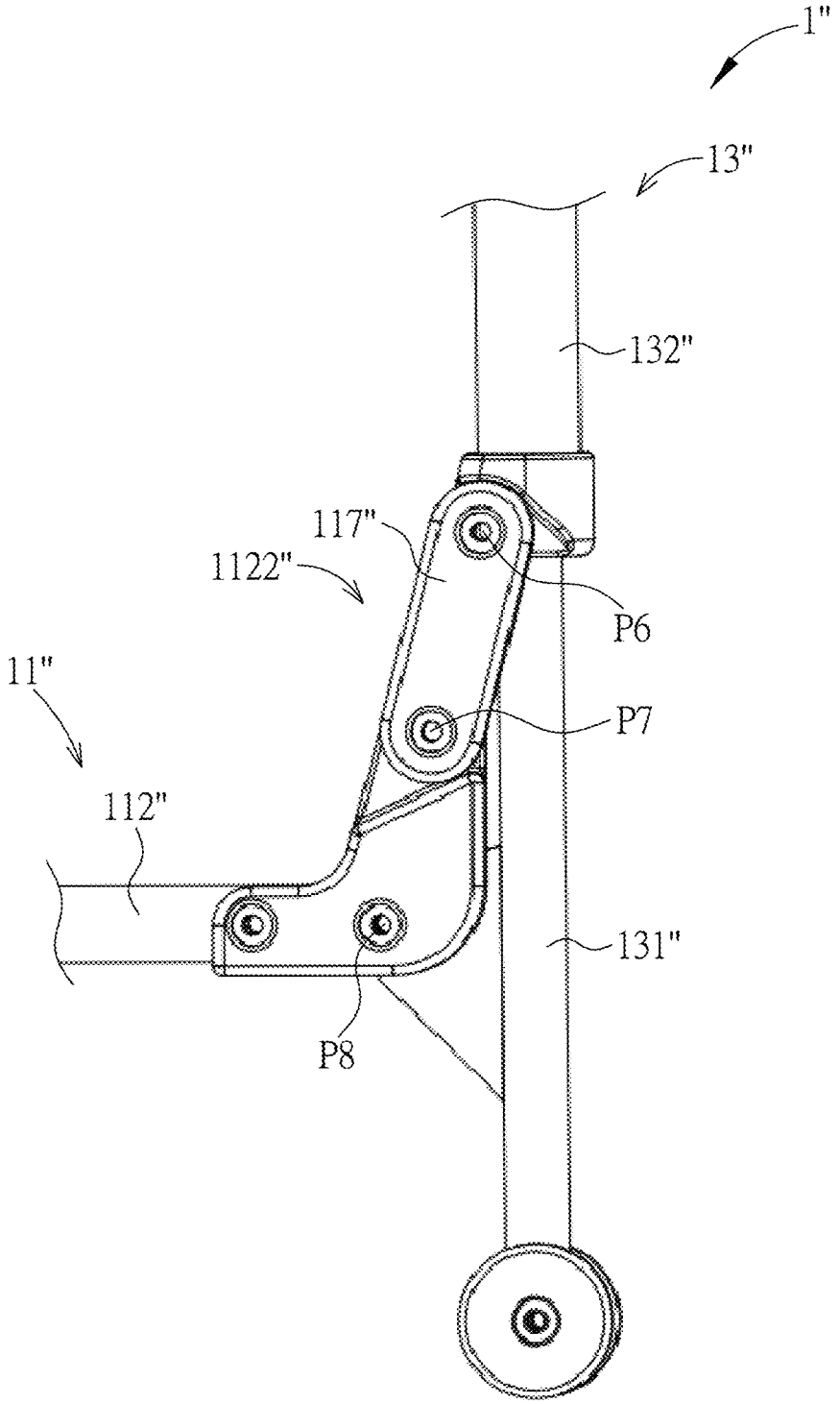
FIG. 24 to FIG. 26 are partial diagrams of the foldable play yard in different states according to the third embodiment of the present invention.
Figure 25:
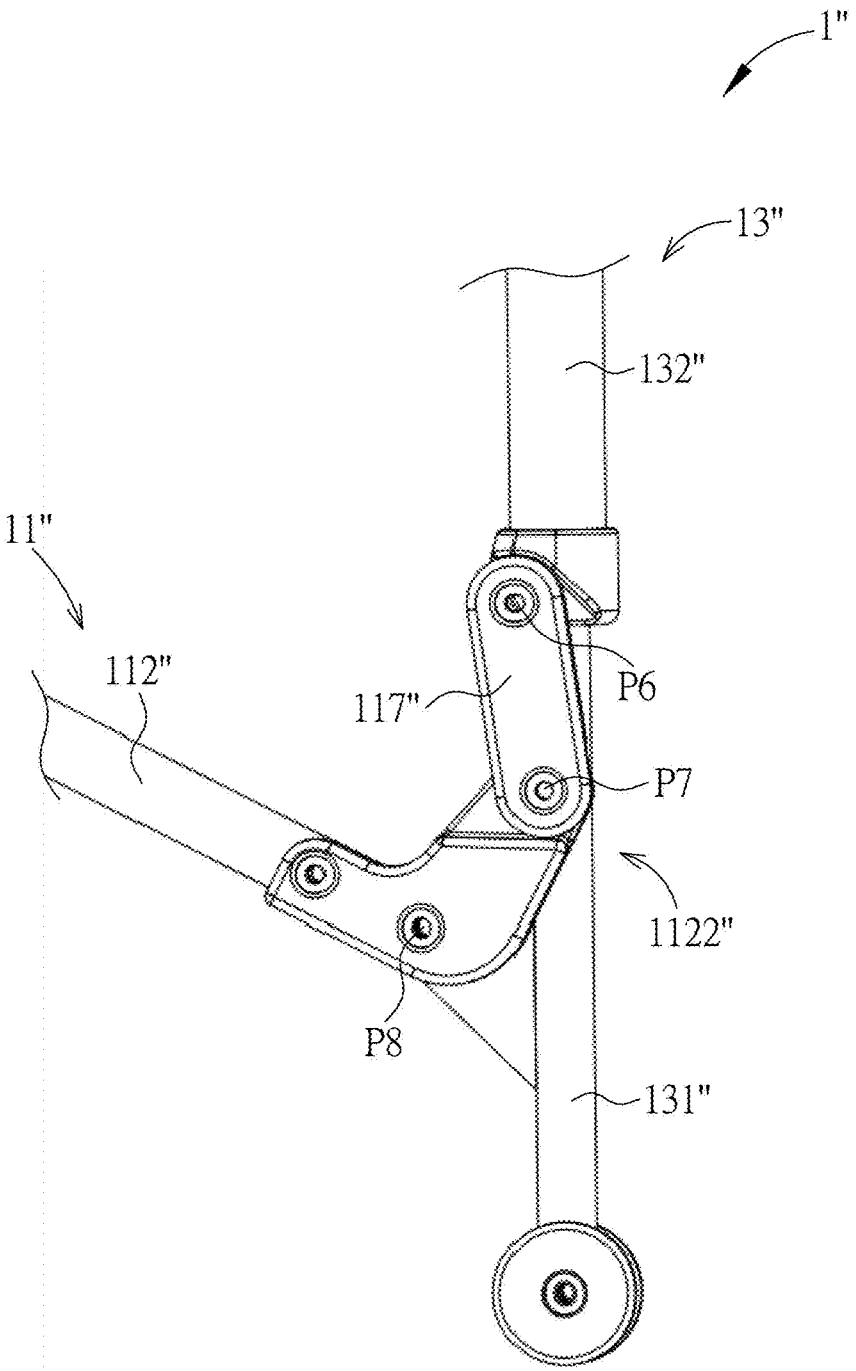
Figure 26:
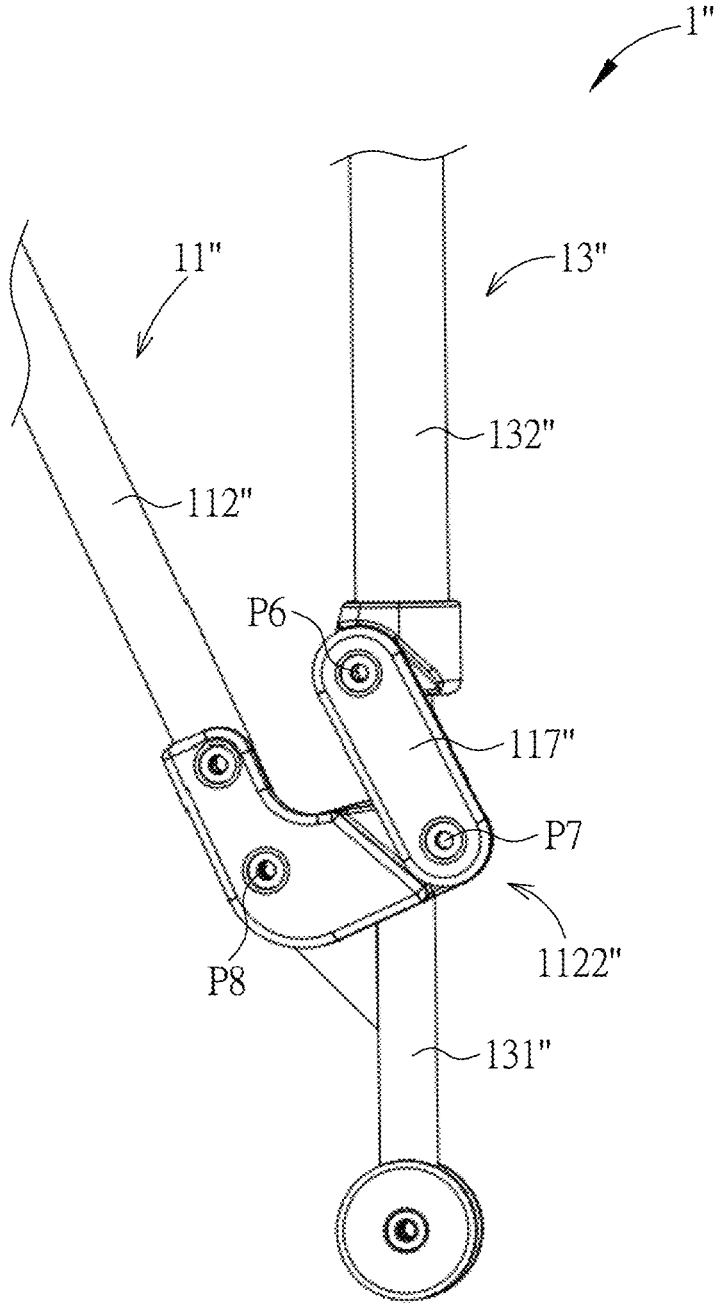

Please refer to FIG. 21 to FIG. 26. FIG. 21 is a schematic diagram of a foldable play yard 1" in the unfolded state according to a third embodiment of the present invention. FIG. 22 is a partial diagram of a corner post assembly 13" according to the third embodiment of the present invention. FIG. 23 is a partial diagram of a floor assembly 11" according to the third embodiment of the present invention. FIG. 24 to FIG. 26 are partial diagrams of the foldable play yard 1" in different states according to the third embodiment of the present invention. As shown in FIG. 21 to FIG. 26, the foldable play yard 1" of this embodiment includes the floor assembly 11", four top rail assemblies 12" and four corner post assemblies 13". Each corner post assembly 13" includes a first column 131" and a second column 132". Structure and operation of the top rail assembly 12" and upper ends of the first column 131" and the second column 132" of the corner post assembly 13" of this embodiment are similar to the ones of the aforementioned embodiment. Detailed description is omitted herein for simplicity. Different from the aforementioned embodiments, the floor assembly 11" of this embodiment includes a floor hub 111", four floor beams 112" pivoted to the floor hub 111" and four pivoting components 117" pivotally connected to second ends 1122" of the four floor beams 112" and lower ends of the four second columns 132". Specifically, each pivoting component 117" is pivotally connected to the second end 1122" of the corresponding floor beam 112" at a pivoting point P7 and pivoted to the lower end of the corresponding second column 132" at a pivoting point P6. Furthermore, a lower end of each first column 131" includes a lower pivoting plate 134" pivoted to an intervening portion of the corresponding floor beam 112" at a pivoting point P8. In other words, each floor beam 112" extends horizontally and turns toward the pivoting point P7 at the pivoting point P8. In such a way, when the floor assembly 11" is folded, the floor beams 112" can drive the second columns 132" by pivoting movements of the pivoting components 117" relative to the floor beams 112" and the second columns 132" to move relative to the first columns 131" from positions as shown in FIG. 24 to positions as shown in FIG. 26, so as to fold the top rail assemblies 12". On the other hand, when the floor assembly 11" is unfolded, the floor beams 112" can drive the second columns 132" by the pivoting components 117 to move relative to the first columns 131" from the positions as shown in FIG. 26 to the positions as shown in FIG. 24, so as to unfold the top rail assemblies 12". Therefore, in this embodiment, it also allows the caregiver to fold and unfolded the entire foldable play yard 1" of the present invention easily by operating the floor hub 111" of the floor assembly 11" even with one hand.

In contrast to the prior art, the present invention utilizes the corner post assembly to drive the top rail assembly to be folded when the floor assembly is folded and further to drive the top rail assembly to be unfolded when the floor assembly is unfolded. Furthermore, the floor assembly of the present invention is foldable by operating the floor hub. Therefore, it allows the caregiver to fold and unfold the entire foldable play yard of the present invention easily by operating the floor hub of the floor assembly even with one hand. Besides, the present invention provides compact folding characteristics. Therefore, it allows the caregiver to transport the play yard easily.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A foldable play yard comprising:

a floor assembly;

at least one top rail assembly comprising at least one upper beam; and at least one corner post assembly movably coupled to the at least one upper beam;

wherein the floor assembly drives the at least one corner post assembly to drive the at least one upper beam to pivot to drive the at least one top rail assembly to be folded when the floor assembly is folded, and the floor assembly drives the at least one corner post assembly to drive the at least one upper beam to pivot to drive the at least one top rail assembly to be unfolded when the floor assembly is unfolded;

wherein the floor assembly comprises at least one latch configured to engage with the at least one corner post assembly for stopping the at least one corner post assembly from driving the at least one upper beam to pivot.

2. The foldable play yard of claim 1, wherein the at least one corner post assembly comprises a first column and a second column, a lower end of the first column is pivoted to the floor assembly, an upper end of the first column is movably connected to the at least one top rail assembly, the second column is movable relative to the first column, a lower end of the second column is movably connected to the floor assembly, an upper end of the second column is pivoted to the at least one top rail assembly, the floor assembly drives the second column to move relative to the first column to drive the at least one upper beam to pivot to drive the at least one top rail assembly to be folded when the floor assembly is folded, and the floor assembly drives the second column to move relative to the first column to drive the at least one upper beam to pivot to drive the at least one top rail assembly to be unfolded when the floor assembly is unfolded.

3. The foldable play yard of claim 2, wherein the floor assembly further comprises a floor hub and at least one floor beam having a first end and a second end, the floor hub is pivoted to the first end of the at least one floor beam, and the lower end of the first column is pivoted to an intervening portion of the at least one floor beam between the first end and the second end of the at least one floor beam.

4. The foldable play yard of claim 3, wherein at least one lower slot is formed on the second end of the at least one floor beam, the at least one corner post assembly further comprises at least one lower pin adjacent to on the lower end of the second column and slidably passing through the at least one lower slot, and the lower end of the second column is rotatably and slidably disposed on the second end of the at least one floor beam by cooperation of the at least one lower pin and the at least one lower slot.

5. The foldable play yard of claim 3, wherein the at least one latch is pivoted to the lower end of the first column for engaging with the second column, so as to stop the second column from being driven by the at least one floor beam to move relative to the first column.

6. The foldable play yard of claim 5, wherein the floor assembly further comprises at least one cable connected to the at least one latch for driving the at least one latch to disengage from the second column to allow the second column to be driven by the at least one floor beam to move relative to the first column.

7. The foldable play yard of claim 5, wherein the floor assembly further comprises at least one resilient component for biasing the at least one latch to engage with the second column.

8. The foldable play yard of claim 3, wherein the at least one corner post assembly further comprises a wheel set disposed on the lower end of the first column.

9. The foldable play yard of claim 3, wherein the second column is pivoted to the second end of the at least one floor beam.

10. The foldable play yard of claim 9, wherein the floor assembly further comprises at least one supporting base connected to the at least one floor beam, and the at least one floor beam drives the at least one supporting base to be located beneath the second column when the floor assembly is unfolded.

11. The foldable play yard of claim 10, wherein the at least one corner post assembly further comprises a wheel set disposed on the lower end of the second column, the wheel set is hidden between the at least one supporting base and the second column when the floor assembly is unfolded to drive the at least one supporting base to be located beneath the second column, and the wheel set is exposed when the floor assembly is folded to drive the at least one supporting base to leave from the second column.

12. The foldable play yard of claim 3, wherein the floor assembly further comprises at least one pivoting component pivoted to the lower end of the second column and the second end of the at least one floor beam.

13. The foldable play yard of claim 2, wherein the first column is movably sleeved inside the second column.

14. The foldable play yard of claim 13, wherein the at least one corner post assembly further comprises an elastic component connected to the first column and the second column, and the elastic component is elastically deformed when the floor assembly is folded to drive the second column to move relative to the first column.

15. The foldable play yard of claim 1, wherein the at least one upper beam has a first end and a second end, the at least one corner post assembly is pivoted to an intervening portion of the at least one upper beam between the first end and the second end of the at least one upper beam, an upper slot is formed on the second end of the at least one upper beam, the at least one corner post assembly further comprises an upper pin slidably passing through the upper slot, and the at least one corner post assembly is rotatably and slidably disposed on the at least one upper beam by cooperation of the upper pin and the upper slot.

16. The foldable play yard of claim 15, wherein the upper slot is inclined relative to the at least one corner post assembly when the foldable play yard is unfolded.

17. The foldable play yard of claim 15, wherein the at least one corner post assembly comprises a first column and a second column movable relative to the first column, an upper end of the second column is pivoted to the intervening portion of the at least one upper beam, and the upper pin is adjacent to an upper end of the first column.

18. The foldable play yard of claim 15, wherein the at least one top rail assembly further comprises a bracket pivoted to the first end of the at least one upper beam.

19. The foldable play yard of claim 1, wherein the floor assembly is operatively connected to the at least one top rail assembly via the at least one corner post assembly such that if the floor assembly is prevented from folding, then the at least one top rail assembly is prevented from folding.

20. The foldable play yard of claim 19, wherein a connection between the floor assembly and the top rail assembly is such that if the at least one top rail assembly is prevented from folding, then the floor assembly is prevented from folding.

* * * * *